US006966369B2

(12) United States Patent
Harrall et al.

(10) Patent No.: US 6,966,369 B2
(45) Date of Patent: Nov. 22, 2005

(54) EXPANDABLE TUBULARS

(75) Inventors: Simon J. Harrall, Inverurie (GB); Robert J. Coon, Missouri City, TX (US)

(73) Assignee: Weatherford/Lamb, Houston, TX (US)

( * ) Notice: Subject to any disclaimer, the term of this patent is extended or adjusted under 35 U.S.C. 154(b) by 81 days.

(21) Appl. No.: 10/610,309

(22) Filed: Jun. 30, 2003

(65) Prior Publication Data

US 2004/0079534 A1 Apr. 29, 2004

Related U.S. Application Data

(63) Continuation-in-part of application No. 10/382,321, filed on Mar. 5, 2003, now Pat. No. 6,782,953, which is a continuation-in-part of application No. 10/003,578, filed on Nov. 2, 2001, now Pat. No. 6,688,395, which is a continuation-in-part of application No. 09/949,057, filed on Sep. 7, 2001, now Pat. No. 6,585,053.

(51) Int. Cl.[7] ..... E21B 17/00
(52) U.S. Cl. ..... 166/207; 166/380; 166/50
(58) Field of Search ..... 166/380, 207, 166/50, 313, 117.6, 387, 384

(56) References Cited

U.S. PATENT DOCUMENTS 5,785,120 A * 7/1998 Smalley et al. ..... 166/55
6,098,717 A * 8/2000 Bailey et al. ..... 166/382
6,135,208 A * 10/2000 Gano et al. ..... 166/313
6,457,532 B1 * 10/2002 Simpson ..... 166/380
6,640,903 B1 * 11/2003 Cook et al. ..... 166/380
6,691,789 B2 * 2/2004 Jackson et al. ..... 166/384

FOREIGN PATENT DOCUMENTS

| | | | |
|---|---|---|---|
| WO | WO 00/37773 | 6/2000 | ..... E21B 43/10 |
| WO | WO 02/29199 | 4/2002 | |
| WO | WO 03/006788 | 1/2003 | |
| WO | WO 03/012255 | 2/2003 | |
| WO | WO 03/048521 | 6/2003 | |

OTHER PUBLICATIONS

U.K. Search Report, Application No. GB0414573.6, dated Apr. 18, 2005.

* cited by examiner

*Primary Examiner*—Frank S. Tsay
(74) *Attorney, Agent, or Firm*—Patterson & Sheridan, LLP

(57) ABSTRACT

The present invention provides apparatus and methods for completing a wellbore using expandable tubulars. Particularly, the invention relates to a system of completing a wellbore through the expansion of tubulars. More particularly, embodiments of the present invention relate to the concurrent expansion of a first and second tubular, wherein the first tubular contains a polished bore receptacle configured to sealingly receive a portion of the second tubular thereby providing a sealable connection therebetween.

39 Claims, 23 Drawing Sheets

EXPANDABLE TUBULARS

CROSS-REFERENCE TO RELATED APPLICATIONS

This application is a continuation-in-part of U.S. patent application Ser. No. 10/382,321, filed on Mar. 5, 2003 now U.S. Pat. No. 6,782,953. This application is also a continuation-in-part of U.S. patent application Ser. No. 10/003,578, filed on Nov. 2, 2001 now U.S. Pat. No. 6,688,395. This application is also a continuation-in-part of U.S. patent application Ser. No. 09/949,057, filed on Sep. 7, 2001 now U.S. Pat. No. 6,585,053. Each of the aforementioned related patent applications is herein incorporated by reference in its entirety.

BACKGROUND OF THE INVENTION

1. Field of the Invention

The present invention relates to wellbore completion. More particularly, the invention relates to a system of completing a wellbore through the expansion of tubulars. More particularly still, the invention relates to the expansion of one tubular into another to provide a sealable connection therebetween. More particularly still, the invention relates to the concurrent expansion of a first and second tubular, wherein the first tubular contains a polished bore receptacle configured to sealingly receive a portion of the second tubular thereby providing a sealable connection therebetween.

2. Description of the Related Art

Wellbores are typically formed by drilling and thereafter lining a borehole with steel pipe called casing. The casing provides support to the wellbore and facilitates the isolation of certain areas of the wellbore adjacent hydrocarbon bearing formations. The casing typically extends down the wellbore from the surface of the well and the annular area between the outside of the casing and the borehole in the earth is filled with cement to permanently set the casing in the wellbore.

As the wellbore is drilled to a new depth, additional strings of pipe are run into the well to that depth whereby the upper portion of the string of pipe, or liner, is overlapping the lower portion of the casing. The liner string is then fixed or hung in the wellbore, usually by some mechanical slip means well known in the art.

In some instances wells are completed with the remote perforating of liner to provide a fluid path for hydrocarbons to enter the wellbore where they flow into a screened portion of another smaller tubular or production tubing. In these instances, the wellbore around the tubing is isolated with packers to close the annular area and urge the hydrocarbons into the production tubing. In other completions, the last string of liner extending into the wellbore is itself pre-slotted or perforated to receive and carry hydrocarbons upwards in the wellbore. In these instances, production tubing is usually connected to the top of the liner to serve as a conduit to the surface of the well. In this manner, the liner is "tied back" to the surface of the well. In order to complete these types of wells, the production tubing is inserted in the top of a liner in a sealing relationship usually accomplished by the use of a polish bore receptacle in the liner top. A polish bore receptacle has a smooth cylindrical inner bore designed to receive and seal a tubular having a seal assembly on its lower end. The polish bore receptacle and seal assembly combination allows the production tubing to be "stung" into the liner in a sealing relationship and be selectively removed therefrom.

Emerging technology permits wellbore tubulars to be expanded in situ. In addition to simply enlarging a tubular, the technology permits the physical attachment of a smaller tubular to a larger tubular by increasing the outer diameter of a smaller tubular with radial force from within. The expansion can be accomplished by a mandrel or a cone-shaped member urged through the tubular to be expanded or by an expander tool run in on a tubular string.

FIGS. 1 and 2 are perspective views of an exemplary expander tool 125 and FIG. 3 is an exploded view thereof. However, it is understood that other means of expansion known to a person of ordinary skill in the art can be utilized to effectively expand tubulars. The expander tool 125 has a body 102, which is hollow and generally tubular with connectors 104 and 106 for connection to other components (not shown) of a downhole assembly. The connectors 104 and 106 are of a reduced diameter (compared to the outside diameter of the longitudinally central body part 108 of the tool 125), and together with three longitudinal flutes 110 on the central body part 108, allow the passage of fluids between the outside of the tool 125 and the interior of a tubular therearound (not shown). The central body part 108 has three lands 112 defined between the three flutes 110, each land 112 being formed with a respective recess 114 to hold a respective roller 116. Each of the recesses 114 has parallel sides and extends radially from the radially perforated tubular core 115 of the tool 125 to the exterior of the respective land 112. Each of the mutually identical rollers 116 is near cylindrical and slightly barreled. Each of the rollers 116 is mounted by means of a bearing 118 at each end of the respective roller for rotation about a respective rotational axis, which is parallel to the longitudinal axis of the tool 125 and radially offset therefrom at 120-degree mutual circumferential separations around the central body 108. The bearings 118 are formed as integral end members of radially slidable pistons 119, one piston 119 being slidably sealed within each radially extended recess 114. The inner end of each piston 119 (FIG. 2) is exposed to the pressure of fluid within the hollow core of the tool 125 by way of the radial perforations in the tubular core 115.

By utilizing an expander tool, such as the one described, the upper end of a liner can be expanded into the surrounding casing. In this manner, the conventional slip assembly and its related setting tools are eliminated. In one example, the liner is run into the wellbore on a run-in string with the expander tool disposed in the liner and connected thereto by a temporary connection. As the assembly reaches a predetermined depth whereby the top of the liner is adjacent a lower section of the casing, the expander tool is actuated and then, through rotational and/or axial movement of the actuated expander tool within the liner, the liner wall is expanded past its elastic limits and into contact with the wall of the casing. Rotation of the expander tool is performed by rotating the run-in string or by utilizing a mud motor in the run-in string to transfer fluid power to rotational movement, for example.

While the foregoing method successfully hangs a liner in a casing without the use of slips, there are problems arising with the use of this method where production tubing must be subsequently stung into the top of a liner. One such problem relates to the polish bore receptacle, which is formed in the inner surface of the liner. When the liner is expanded into the inner wall of the casing, the liner, because of the compliant rollers of the expander tool, tends to assume the shape of the casing wall. Because the casing is not perfectly round, the expanded liner is typically not a uniform inner circumference. Further, the inside surface of the liner is necessarily roughened by the movement of the rollers of the expander tool during expansion.

There is a need therefore for an improved method of expanding a first tubular within a wellbore while allowing the first tubular to sealingly engage a second tubular. Furthermore, there is a need for a method of concurrently expanding a first and a second tubular, wherein the first tubular contains a polished bore receptacle configured to sealingly receive a portion of the second tubular thereby providing a sealable connection therebetween.

SUMMARY OF THE INVENTION

The present invention provides apparatus and methods for completing a wellbore using expandable tubulars. According to one embodiment of the present invention, a method of completing a well includes first running a first tubular into a wellbore, wherein the wellbore includes a cased portion. The first tubular is suspended at a selected depth within the wellbore and at least a portion of the first tubular is expanded. A second tubular is run into the wellbore and a portion of the second tubular is located proximate the first tubular, thereby leaving an overlapping area therebetween. At least a portion of the second tubular is also expanded.

According to another embodiment of the present invention, a method of completing a well includes first running a first tubular into a wellbore, wherein the wellbore includes a cased portion. The first tubular is suspended at a selected depth within the wellbore. A second tubular is run into the wellbore and a portion of the second tubular is mated into a portion of the first tubular. The inner diameter of the mated portion of the first tubular is configured to sealingly receive the outer diameter of the mated portion of the second tubular, thereby creating an overlapping area between the first and second tubulars. A substantial portion of the first and second tubulars including the overlapping area between the first and second tubulars is concurrently expanded.

According to another embodiment of the present invention, a method of completing a well includes first running a first tubular into a wellbore, wherein the wellbore comprises a cased portion. The first tubular is suspended at a selected depth below the cased portion of the wellbore and at least a portion of the first tubular is expanded against an inner surface of the wellbore below the cased portion. A second tubular is run into the wellbore and a portion of the second tubular is located proximate the first tubular, thereby leaving an overlapping area therebetween. At least a portion including the overlapping area of the second tubular is also expanded.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention generally relate to methods and apparatus for completing a well. Particularly, the invention relates to a system of completing a wellbore through the expansion of tubulars. More particularly, embodiments of the present invention relate to the concurrent expansion of a first and second tubular, wherein the first tubular contains a polished bore receptacle configured to sealingly receive a portion of the second tubular thereby providing a sealable connection therebetween.

Embodiments of the invention are described below with terms designating orientation in reference to a vertical wellbore. These terms designating orientation should not be deemed to limit the scope of the invention. Embodiments of the invention can also be used in a non-vertical wellbore, such as a horizontal wellbore.

Figure 1:
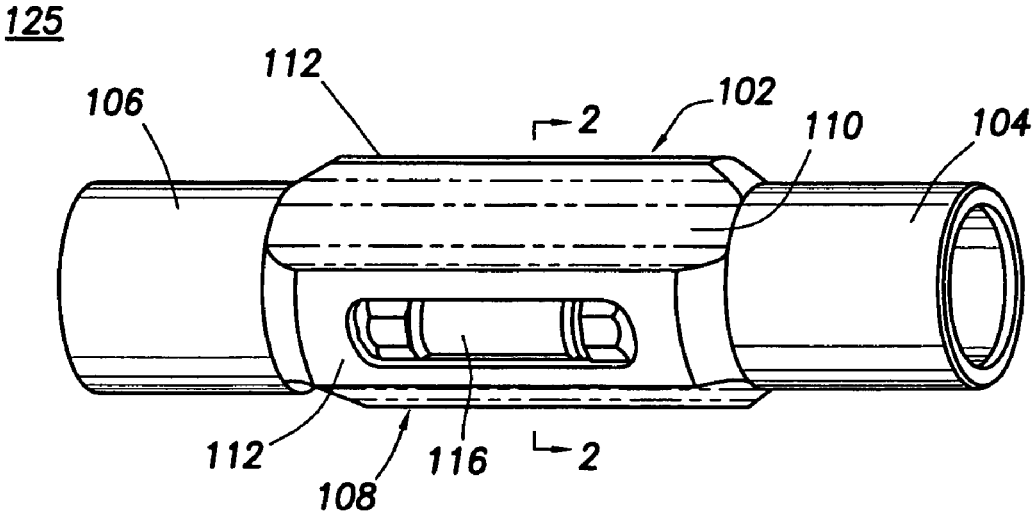
FIG. 1 is a perspective view of an expander tool.
Figure 2:
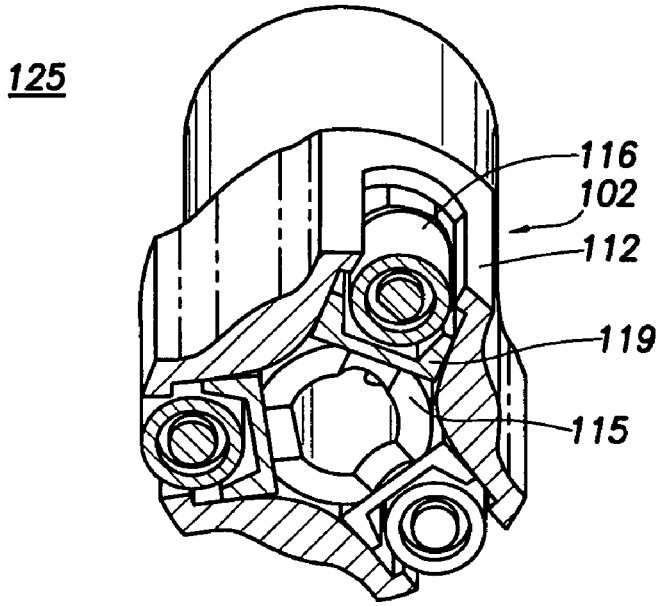
FIG. 2 is a perspective view of the expander tool.
Figure 3:
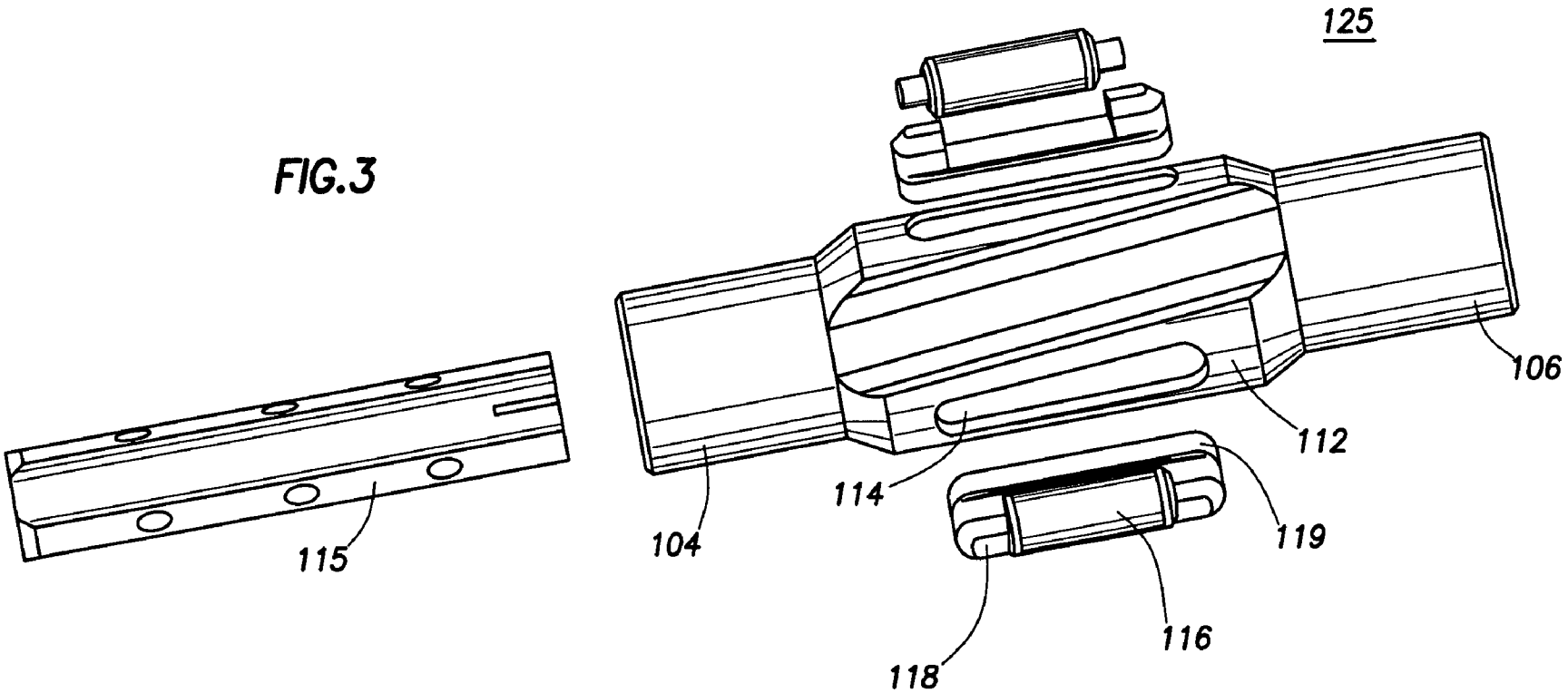
FIG. 3 is an exploded view of the expander tool.
Figure 4A:
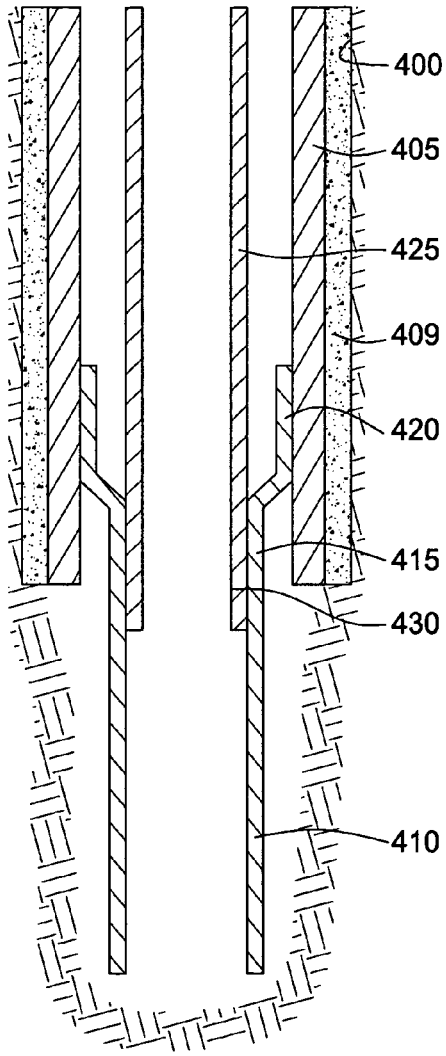
FIGS. 4A–B provide section views of the present invention according to one embodiment.
Figure 4B:
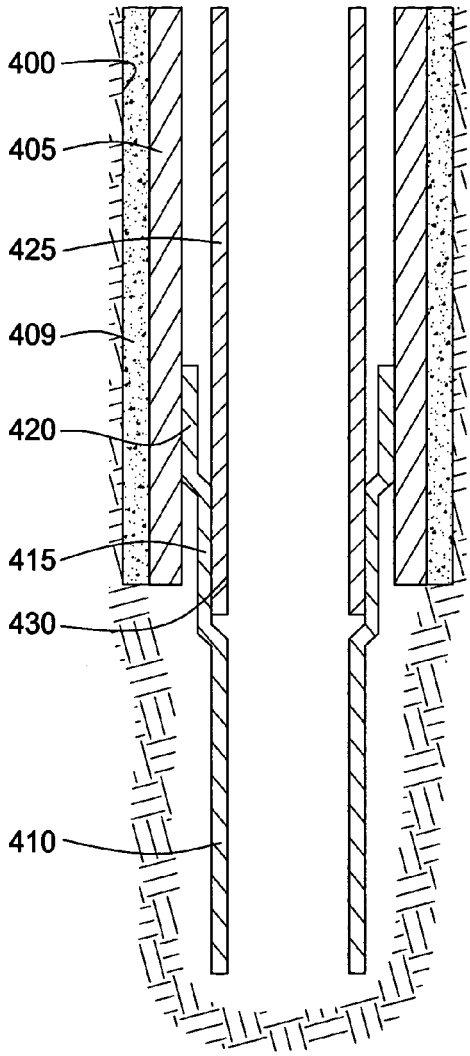

FIGS. 4A and 4B provide section views of the present invention according to one embodiment. FIG. 4A is a section view of a wellbore 400 having casing 405 along a portion of the walls thereof and cement 409 filling an annular area between the casing 405 and the earth formation. FIG. 4A particularly illustrates a section of the wellbore 400 where the casing 405 terminates. Also shown in FIG. 4A is an upper portion 420 of a first tubular 410 that has been expanded into contact with the casing 405 by an expander tool (not shown), such as of the type previously described.

The first tubular 410 is set in the casing 405 by positioning the upper portion 420 of the first tubular in an overlapping relationship with the lower portion of the casing 405, as illustrated in FIG. 4A. Thereafter, the expansion tool (not shown) is employed to expand the first tubular 410 at an upper portion 420 towards the casing 405 and into engagement with the casing 405. The expansion tool is then removed by any means as known to a person of ordinary skill in the art, such as a mechanical connection means that can be remotely disengaged after the expansion process is complete.

After the upper portion 420 of the first tubular 410 is attached to the casing 405, the expander tool is removed and subsequently, a second tubular member 425 is run into the wellbore 400 with an expansion tool (not shown) disposed therein on a run-in string. A second portion 415 of the tubular 410 disposed below the expanded upper portion 420 is configured to serve as a polished bore receptacle (PBR). The inner diameter of the PBR 415 is designed to allow the second tubular 425 to line the PBR 415, wherein the outer diameter of the second tubular 425 is slightly smaller than the inner diameter of the PBR 415. Accordingly, the second tubular 425, which can serve as production tubing, is run into the wellbore 400 until sealably engaging the PBR portion 415 of the first tubular 410. As illustrated in FIG. 4A, the second tubular member 425 has an outside diameter that easily fits within the PBR portion 415 of the first tubular 410. Proper placement of the second tubular member 425 in the first tubular 410 can be ensured using a profile (not shown) formed on the member with a mating groove formed in the interior of the first tubular 410. It is understood that a polished bore receptacle could be formed in any portion of the first tubular 410.

A substantial portion of the second tubular 425 is expanded into contact with the wall of the first tubular 410, whereby the weight of the second tubular 425 is transferred to the first tubular 410, as shown in FIG. 4B. The frictional force between the second tubular 425 and the PBR 415 is increased by the concurrent expansion of both a substantial portion of the second tubular 425 and the PBR portion 415 of the first tubular 410. The tubulars 410 and 425 are expanded until the inner diameter of the expanded portion of the second tubular 425 is substantially equal to that of the first tubular 410 below its PBR portion 415. The expansion of both tubulars 410 and 425 allows the second tubular 425 to be sealably engaged with the first tubular 400 while maintaining a substantially equivalent inner diameter throughout the tubulars 410 and 425. In this manner, the first tubular 410 is tied back to the surface of the well and hydrocarbons can follow the fluid path formed in the first tubular 410 and in the production tubing 425.

As previously described, the tubulars 410 and 425 can be run in with an expander tool on a run in string. A temporary connection is included between the expander tool and the tubulars 410 and 425, wherein the temporary connection can be a shearable connection or can be some other mechanical or hydraulic arrangement wherein the connection can bear the weight of the tubulars 410 and 425 but can later be remotely disconnected to permit the run in string and expander tool to move independent of the tubulars 410 and 425. In one embodiment, the temporary connection is a collet (not shown) with hydraulically actuated release means.

Figure 5A:
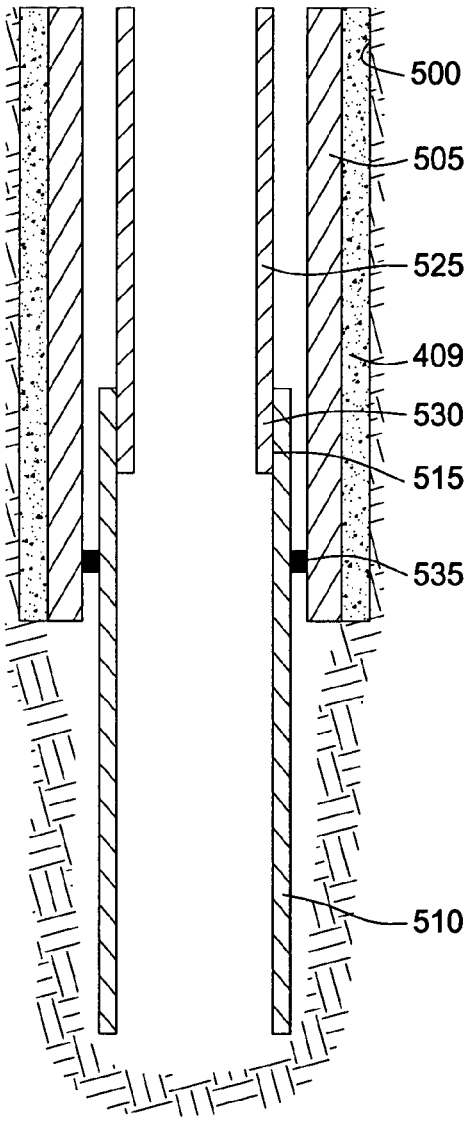
FIGS. 5A–B show section views of the present invention according to another embodiment of the present invention.
Figure 5B:
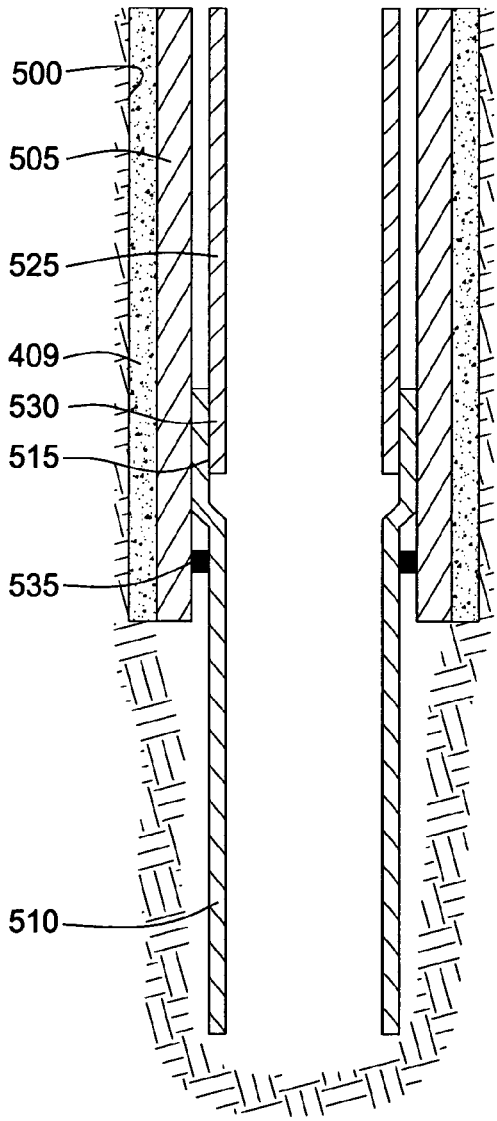

FIGS. 5A–B provide section views of the present invention according to another embodiment. As shown in FIG. 5A, a first tubular 510 is hung along a lower portion of casing 505 by a conventional means, such as a slip mechanism 535. However, it is understood that other hanging devices well known by a person of ordinary skill in the art can be employed to hang the first tubular. The first tubular 510 is located at a position wherein a portion of the first tubular 510 overlaps a portion of the casing 505. The first tubular 510 includes a PBR 515 disposed at an upper portion thereof.

As shown in FIG. 5A, the PBR 515 of the first tubular 510 is designed to receive a second tubular 525, which as previously described can be used as production tubing. The outer diameter of the second tubular 525 is designed to line the inner diameter of the PBR 515. The PBR 515 serves to sealably engage a lower portion 530 of the second tubular 525. As described in FIGS. 4A–B, an expander tool (not shown) is used to concurrently expand a substantial portion of the second tubular 525 including the lower portion 530 and the PBR 515 of the first tubular 510. The PBR 515 is expanded until contacting the inner surface of the casing 505. The expansion of both tubulars 510 and 525 allows for a substantially constant inner diameter throughout the tubulars 510 and 525, as shown in FIG. 5B. In addition, the simultaneous expansion of tubulars 510 and 525 provides a greater frictional engagement force between the tubulars.

Figure 6A:
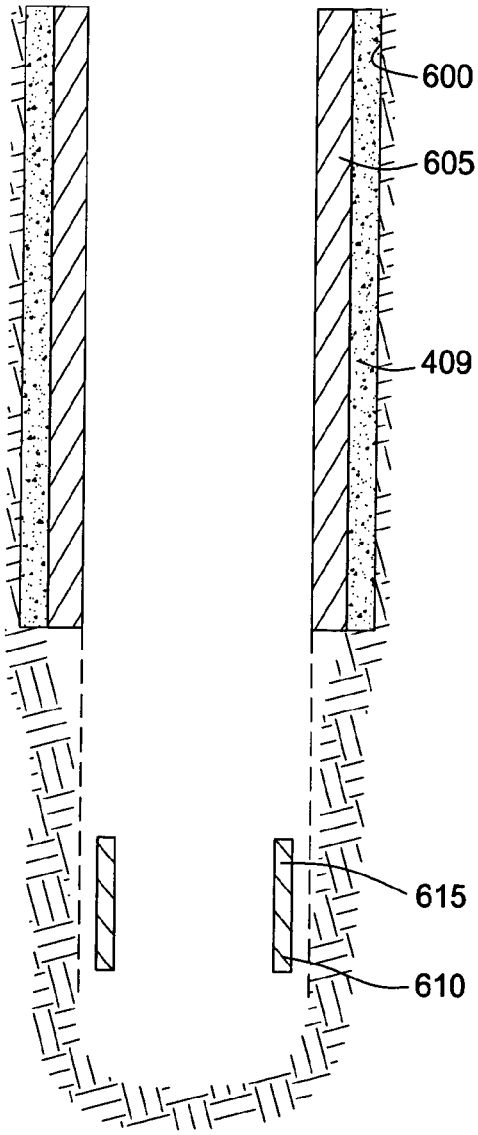
FIGS. 6A–D provide section views of the present invention according to another embodiment of the present invention.
Figure 6B:
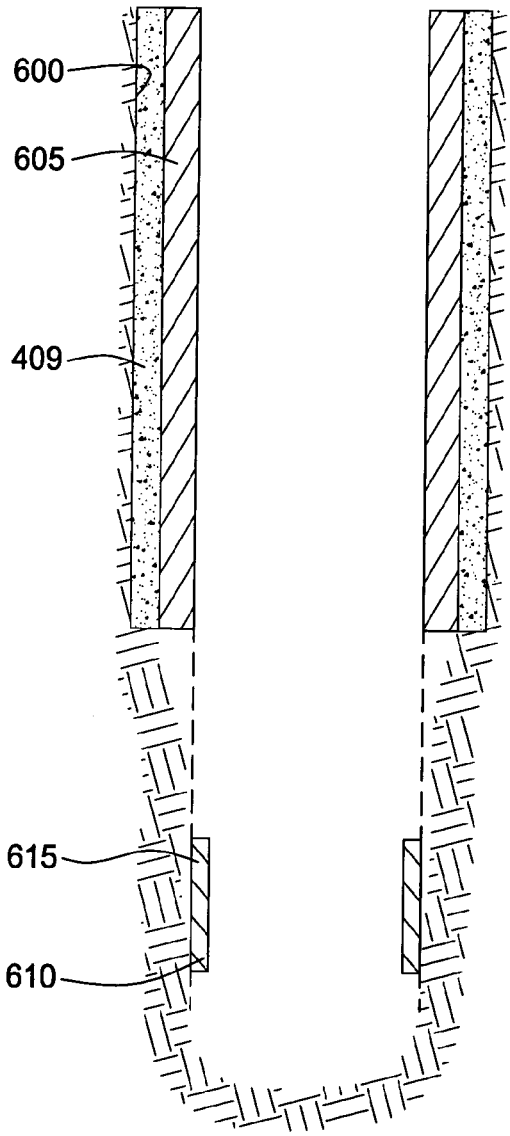

FIGS. 6A–D provide section views of the present invention according to another embodiment. As shown in FIG. 6A, a first tubular or clad 610 is located below a string of casing 605. In one embodiment, "clad" or "open hole clad" represents a patch or protective layer, such as a tubular, used to clad or cover a section within a wellbore. Accordingly, a clad is generally not attached to the existing casing and is disposed below an existing casing. Clads can be employed within a wellbore to relieve a multitude of adverse downhole conditions, such as to seal fractured reservoirs or perforated sections of the wellbore in which large quantities of water can be produced from discrete zones. As will be described in further detail, more than one clad may be employed within a wellbore. The clads used in the following embodiments are described as tubular members that effectively cover the desired section; however, it is understood that other clad systems well known to a person of ordinary skill in the art may also be utilized. As described, the clad 610 serves to isolate a particular un-lined section of the wellbore 600. The clad 610 includes a PBR portion 615 disposed at an upper portion thereof. As previously described, an expander tool (not shown) is used to suspend and expand a substantial portion of the clad 610 including the PBR 615 against the present formation, thereby frictionally engaging the clad 610 to the formation, as illustrated in FIG. 6B.

Figure 6C:
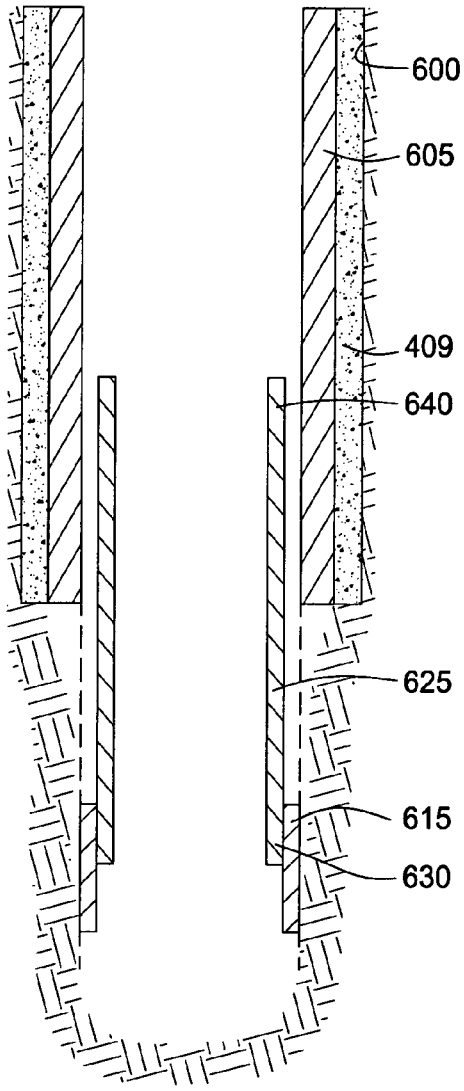
Figure 6D:
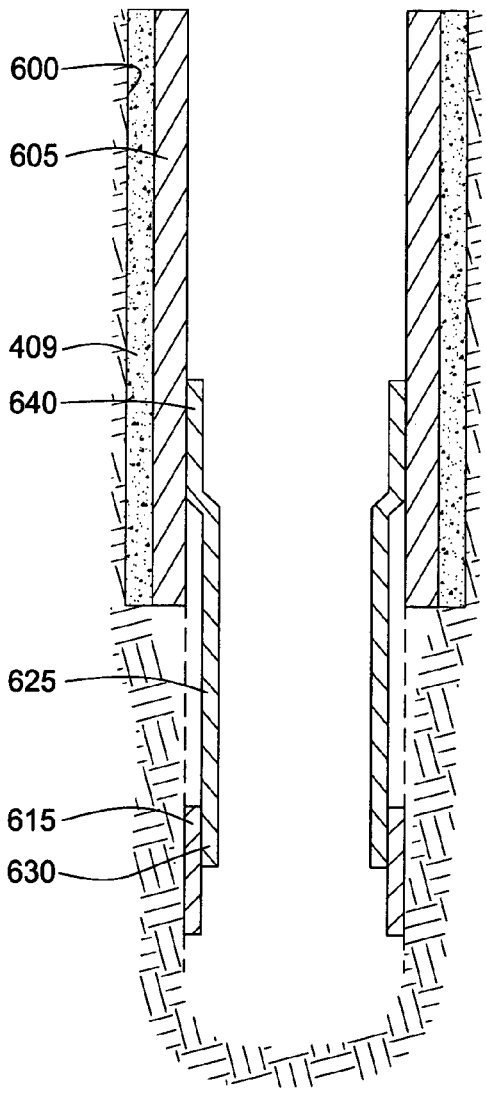

Referring to FIG. 6C, a tubular 625 is lowered into the wellbore 600 within the casing 605. As in previously described embodiments of the invention, the outer diameter of the tubular 625 is designed to line the inner diameter of the PBR 615. The PBR 615 overlaps a portion of the tubular 625, thereby forming a seal between the tubular 625 and the clad 610. As shown, an upper portion 640 of the tubular 625 overlaps but does not make contact with the casing 605. In order to form a seal between the annular area surrounding the tubular 625 and the casing 605, an expander tool (not shown) is again employed to expand the upper portion 640 of the tubular 625 into contact with the casing 605, as shown in FIG. 6D. The expanded portion 640 of the tubular 625 can also be designed to function as a PBR to receive subsequent tubing or liners. Since the tubular 625 is sealingly engaged to both the casing 605 and the clad 610, the tubular 625 serves to isolate or "straddle" the area between the casing 605 and the clad 610.

Figure 7A:
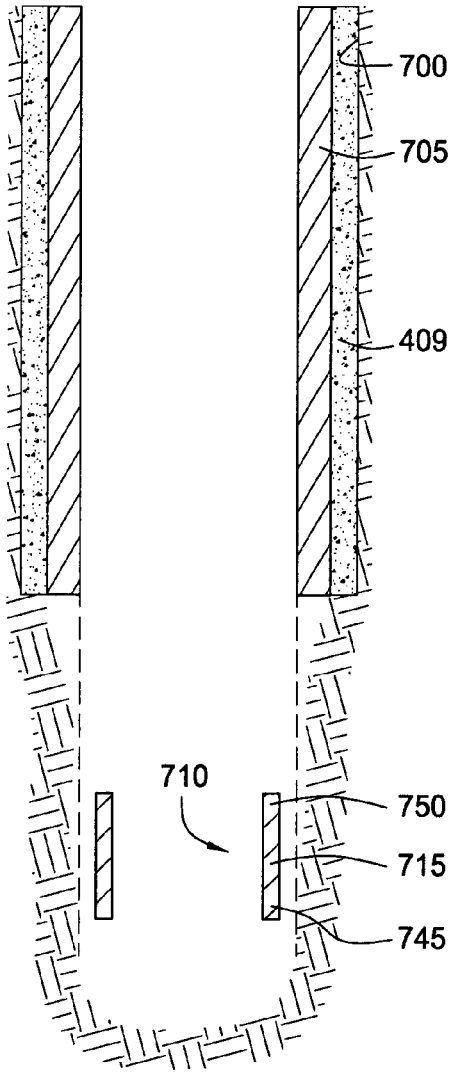
FIGS. 7A–D provide section views of the present invention according to another embodiment of the present invention.
Figure 7B:
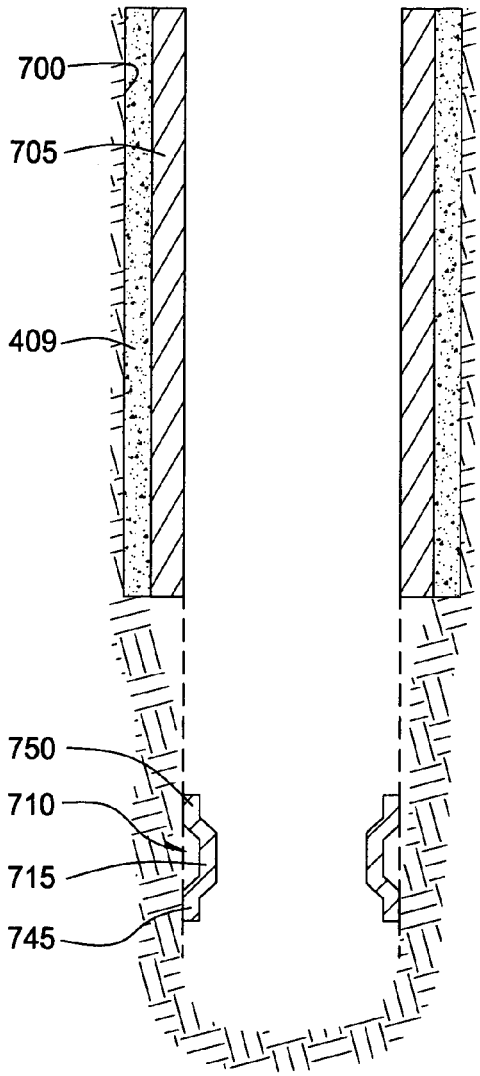

FIGS. 7A–D provide section views of the present invention according to another embodiment of the invention. As in the embodiment of the present invention described by FIGS. 6A–B, FIG. 7A illustrates a first tubular or clad 710 disposed within the wellbore 700 below the casing 705. An expansion tool (not shown), as previously described, can be used to suspend the clad 710 within the wellbore 700 and to then expand an upper portion 750 and a lower portion 745 of the clad 710 against the surrounding wellbore 700. The clad 710 is now frictionally engaged to the wellbore 700, as shown in FIG. 7B.

Figure 7C:
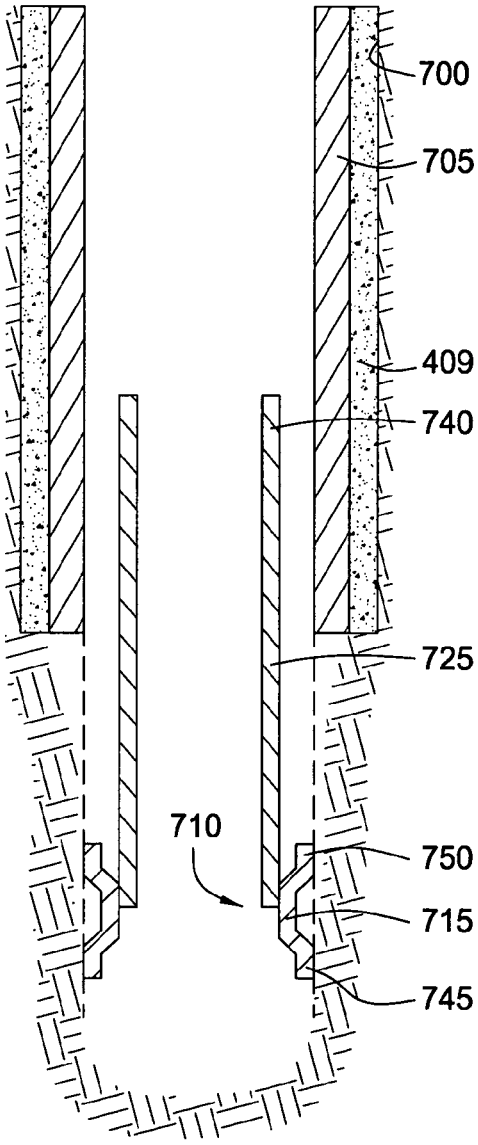
Figure 7D:
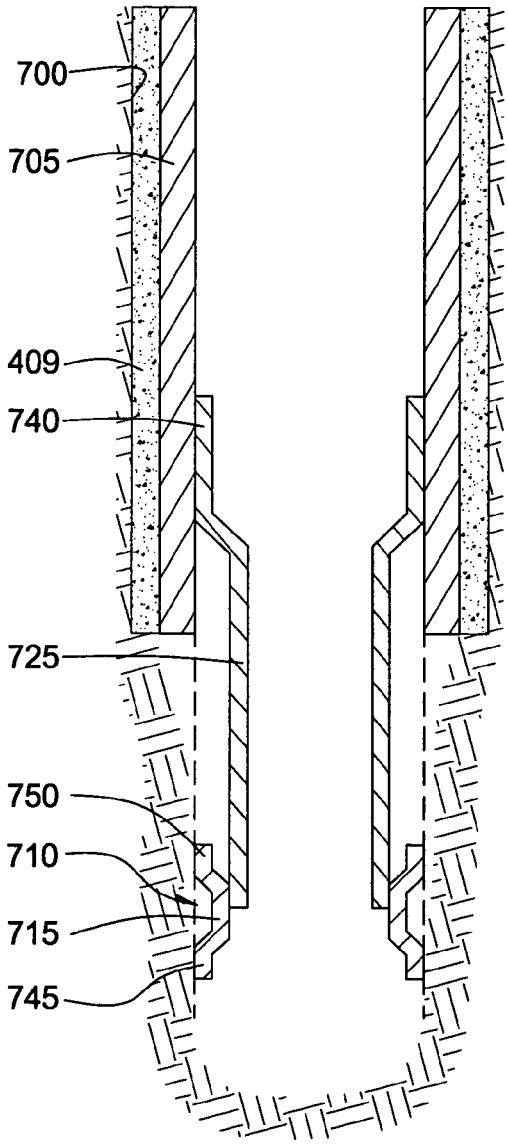

Referring to FIG. 7C, a tubular 725 is run into the wellbore 700 and into a PBR portion 715 of the clad 710. As in previously described embodiments, the tubular 725 is designed to line the PBR 715, thereby becoming sealably engaged to the clad 710. In order to form a seal between the annular area surrounding the tubular 725 and the casing 705, an expander tool (not shown) is again employed to expand an upper portion 740 of the second tubular 725 into contact with the casing 705, as shown in FIG. 7D. The expanded portion 740 of the tubular 725 can also be designed to function as a PBR to receive subsequent tubing or liners. As previously described, the tubular 725 can be used to straddle or isolate the area between the existing clad 710 and the casing 705.

Figure 8:
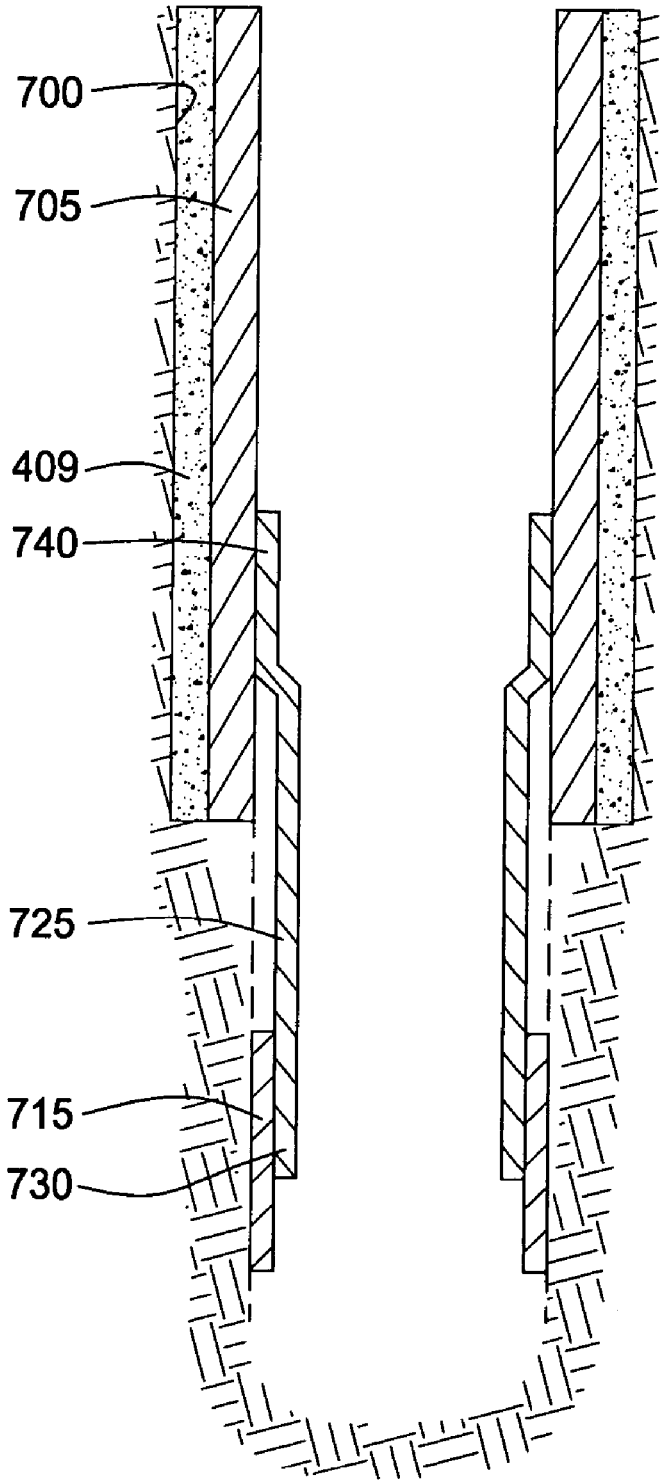
FIG. 8 illustrate another embodiment of the present invention as described in FIGS. 7A–D.

In another embodiment, a substantial portion of the tubular 725 and the PBR 715 can be concurrently expanded until the PBR 715 of the tubular 725 contacts the wellbore 700, as shown in FIG. 8. As previously described, the simultaneous expansion of the tubular 725 and the PBR 715 serve to increase the frictional engagement between the two and to increase the inner diameter of the tubular 725. An upper portion 740 of the tubular 725 is also expanded into contact with the casing 705 so as to create a sealed area between the wellbore 700 and the tubular 725. The upper portion 740 of the tubular 725 can also be configured to function as a PBR.

Several additional embodiments of the present invention for expanding tubulars and/or clads within a wellbore are described in detail below. The following embodiments are only a selection of exemplary embodiments that can be adopted in accordance with aspects of the present invention. It is, therefore, understood, that other equally effective embodiments may be used in accordance with the present invention.

Figure 9A:
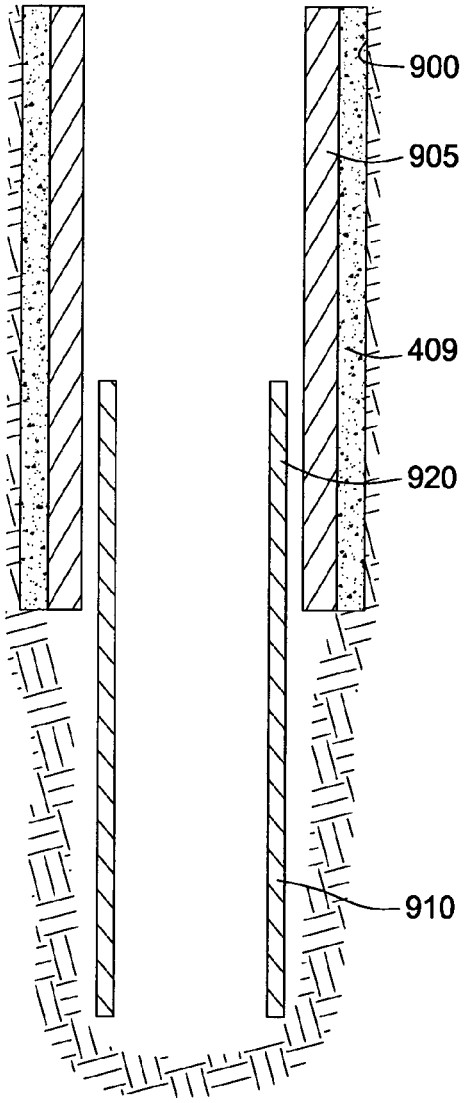
FIGS. 9A–D illustrate section views of another embodiment of the present invention.
Figure 9B:
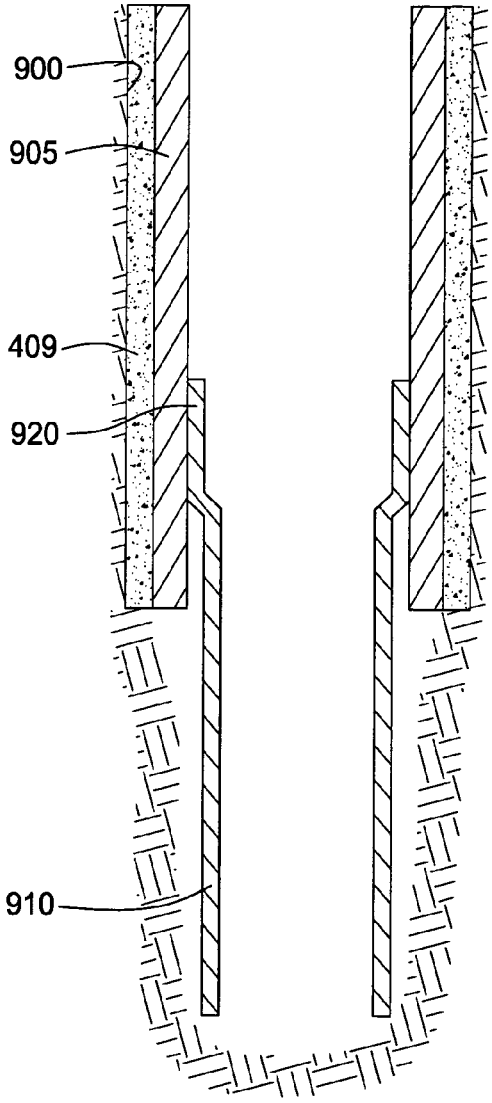
Figure 9C:
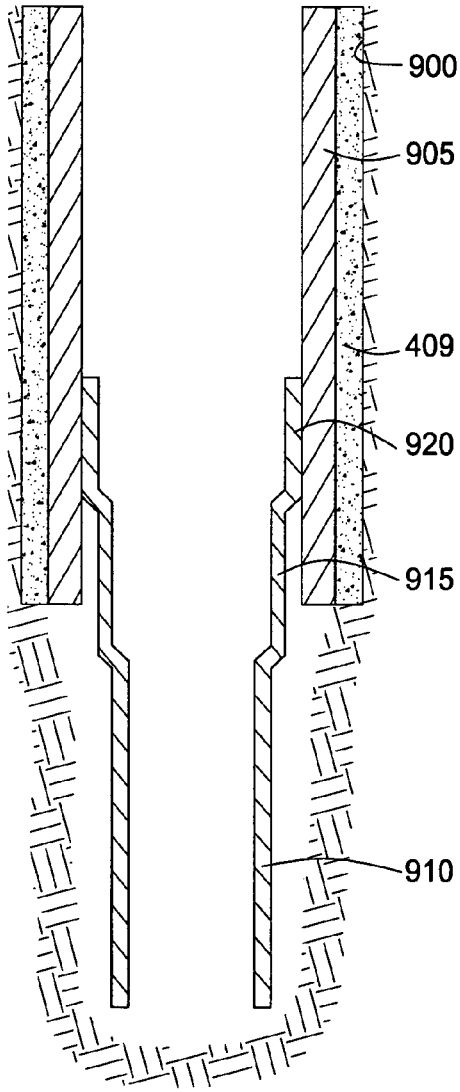
Figure 9D:
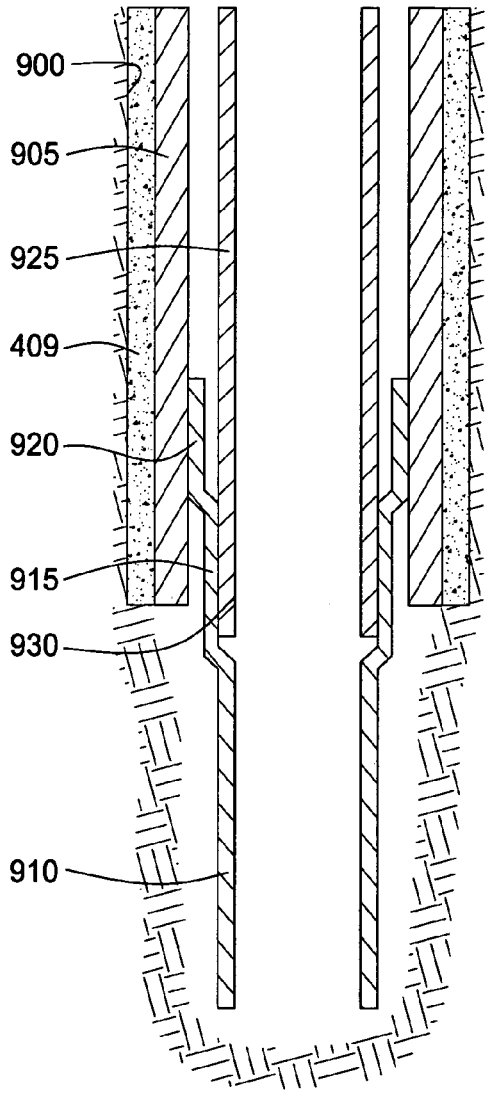

FIGS. 9A–D illustrate section views of another embodiment of the present invention. As shown in FIG. 9A, a first tubular 910 is run into the wellbore 900 to a position wherein an upper portion 920 of the first tubular 910 overlaps a bottom portion of an existing casing 905. As previously described, the first tubular 910 can be run into the wellbore 900 using a run-in sting (not shown) having an expander tool disposed within the first tubular 910 and used to support the first tubular. The expander tool is then used to expand an upper portion 920 of the first tubular 910 into contact with the casing 905. The expansion of the first tubular 910 allows the first tubular 910 to become frictionally engaged with the casing 905, thereby transferring the weight of the first tubular 910 to the casing 905, as shown in FIG. 9B. The expander tool is then again employed to expand a second portion 915 of the first tubular 910. As shown in FIG. 9C, the second portion 915 is disposed below the previously expanded upper portion 920 and is not expanded into contact with casing 905. More particularly, the second expanded portion 915 is expanded to receive a second tubular 925 of a substantially equal inner diameter to the unexpanded portion of the first tubular 910 below the first and second expanded portions, 920 and 915, respectively. In one embodiment, the second expanded portion 915 is designed to function as a polished bore receptacle for sealably receiving the second tubular 925, as shown in FIG. 9D.

Figure 10A:
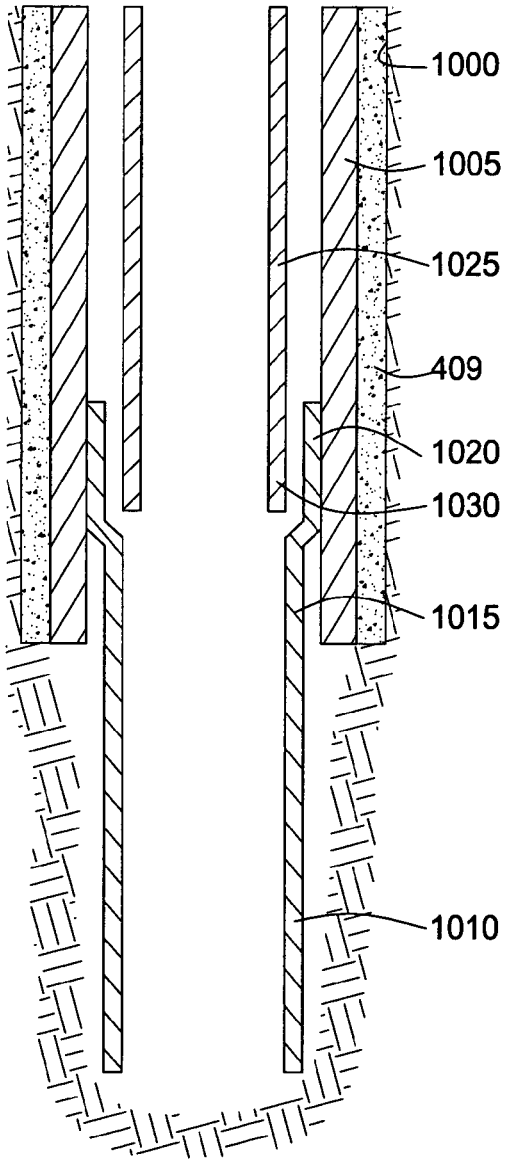
FIGS. 10A–B show section views of the invention according to another embodiment.
Figure 10B:
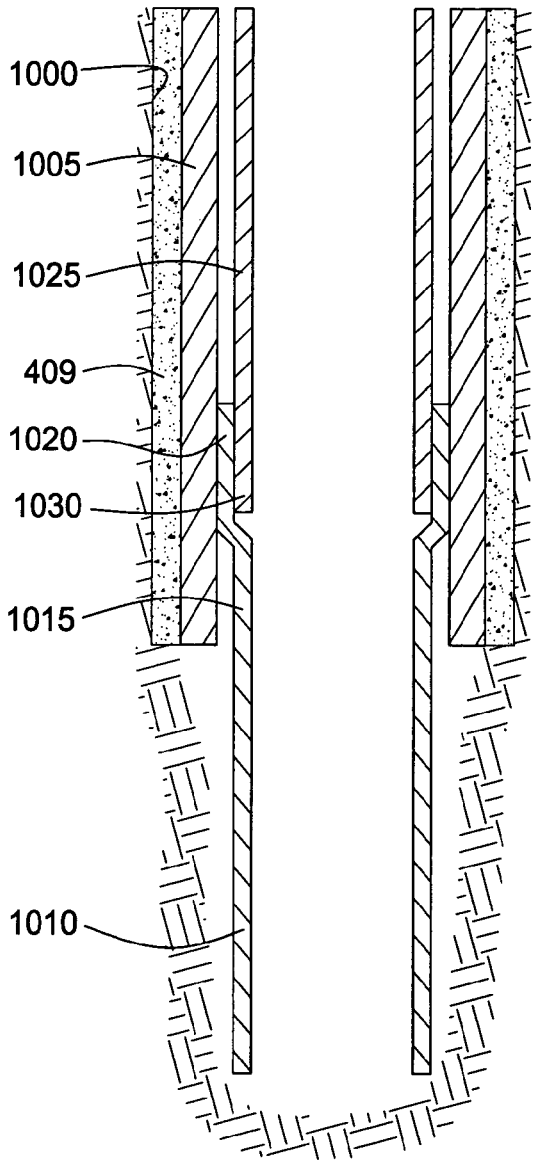

Another embodiment of the present invention is illustrated in FIGS. 10A–B. As in the embodiment described by FIGS. 9A–D, an upper portion 1020 of a first tubular 1010 is expanded into frictional engagement with an existing casing 1005. Once the first tubular 1010 has been set within the wellbore 1000, a second tubular 1025 is run into the wellbore 1000 and hung in a location wherein a bottom portion of the second tubular 1025 overlaps a portion of the expanded portion 1020 of the first tubular 1010. Initially, the second tubular 1025 is not in contact with the casing 1005 or the first tubular 1010, as shown in FIG. 10A. A substantial portion of the second tubular 1010 is then expanded into contact with the expanded portion 1020 of the first tubular 1010. In one embodiment, the expanded portion 1020 includes a PBR portion 1015 for sealingly receiving the second tubular 1025, as shown in FIG. 10B. The engagement of the second tubular 1025 with the expanded portion 1020 of the first tubular 1010 forms a substantially constant diameter throughout the two tubulars 1010, 1025.

Figure 11A:
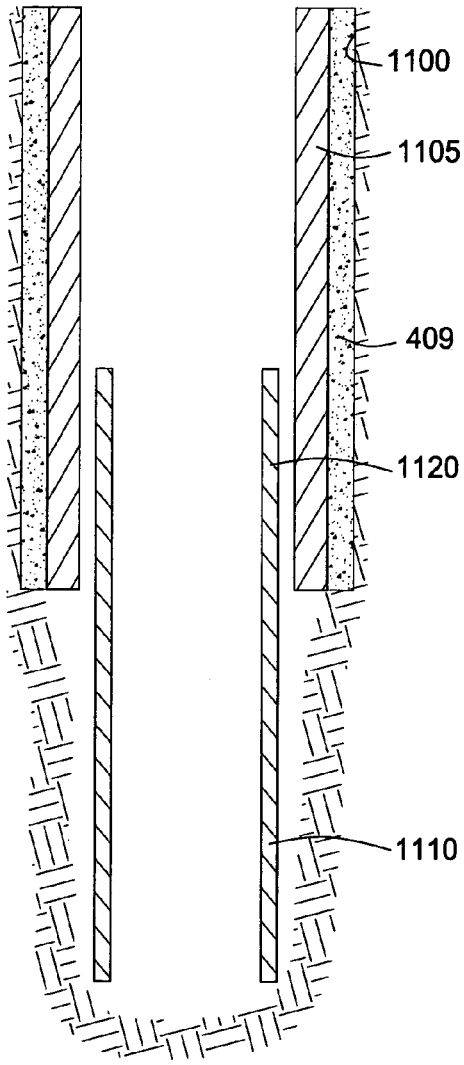
FIGS. 11A–D provide section views of the invention according to another embodiment.
Figure 11B:
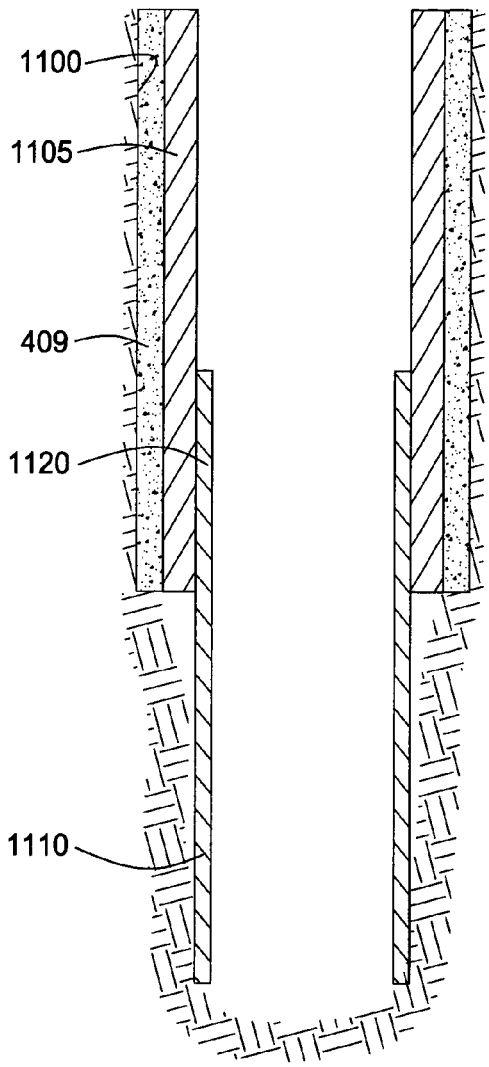

FIGS. 11A–D provide section views of the invention according to another embodiment. As in FIG. 9A, FIG. 11A illustrates a first tubular 1110 being suspending in an overlapping position with casing 1105. As previously described, the first tubular 1110 may be suspended by a run in string or other means well known in the art. An expander tool (not shown) is disposed within the first tubular 1110 and is used to expand a substantial portion of the first tubular 1110 to a constant diameter wherein an upper portion 1120 of the first tubular 1110 is placed in contact with the casing 1105, as shown in FIG. 11B. The weight of the first tubular 1110 is now completely transferred to the casing 1105 and the frictional force between the casing 1105 and the upper portion 1120 of the first tubular 1110 provides the necessary force to effectively suspend the first tubular 1110 within the wellbore 1100.

Figure 11C:
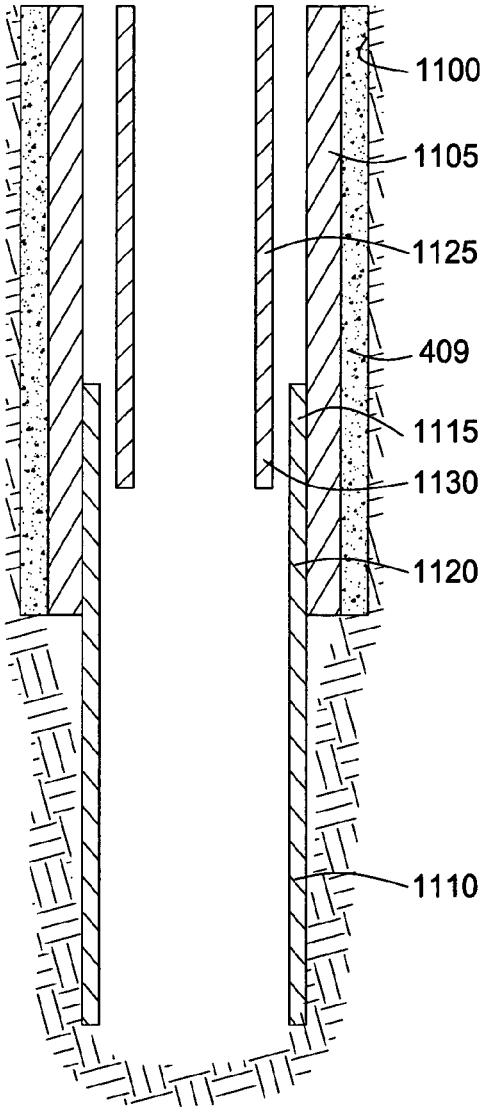
Figure 11D:
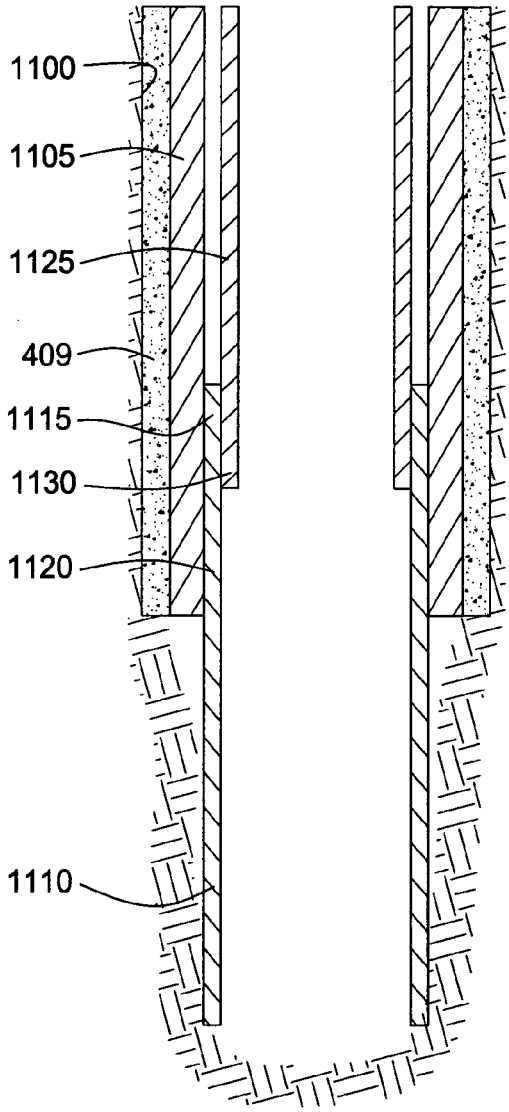

As shown in FIG. 11C, a second tubular 1125 is run into the wellbore 1100 and suspended in an overlapping position with the first tubular 1110 and the casing 1105. Initially, the second tubular 1125 is not in contact with the casing 1105 or the first tubular 1110. An expander tool (not shown) is used to expand a substantial portion of the second tubular 1125. The second tubular 1125 is expanded until a lower portion 1130 of the second tubular contacts the upper portion 1120 of the first tubular 1110, as shown in FIG. 11D. In one embodiment, the upper portion 1120 of the first tubular 1110 includes a PBR 1115 to effectively receive and seal a lower portion 1130 of the second tubular.

Figure 12A:
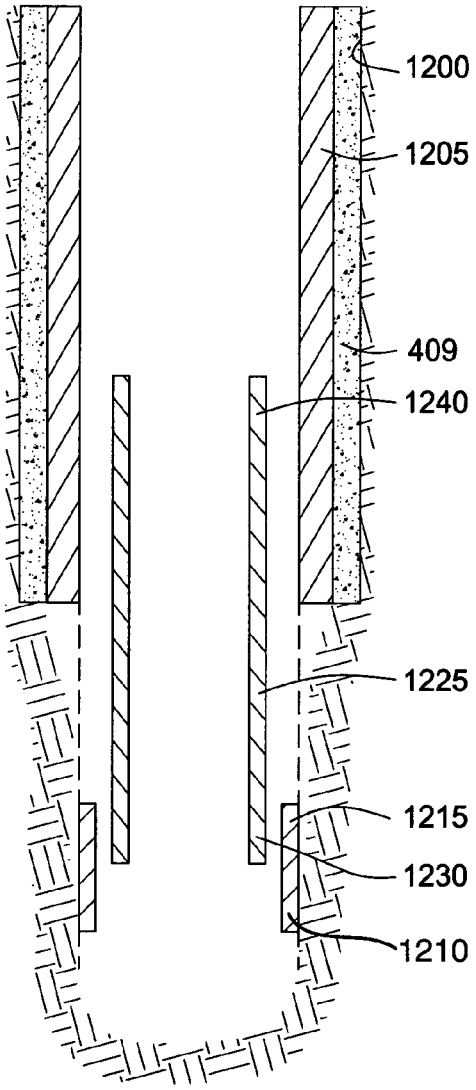
FIGS. 12A–B illustrate section views of the present invention according to another embodiment.
Figure 12B:
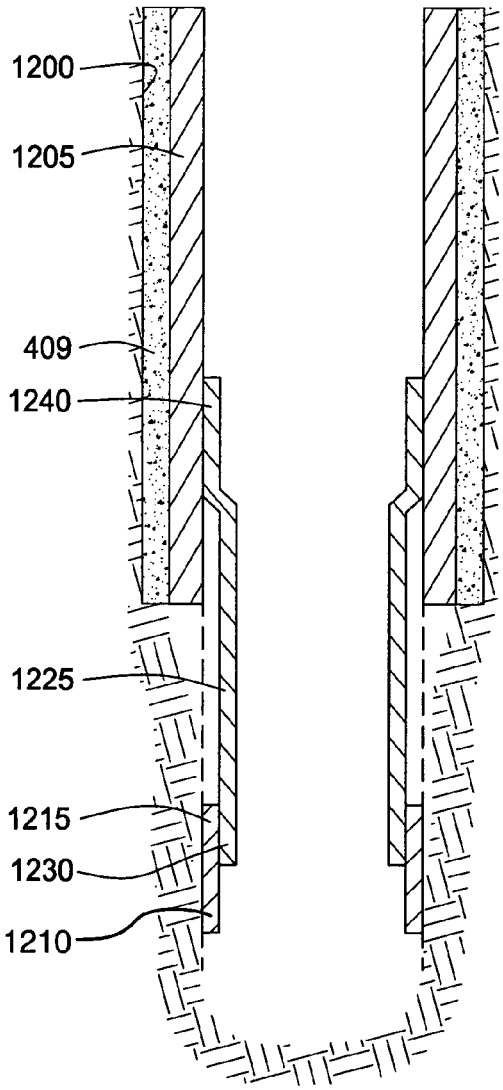

FIGS. 12A–B illustrate section views of the present invention according to another embodiment. As in FIGS. 6A–B, a clad 1210 has been frictionally engaged against an unlined portion of the wellbore 1200 below an existing casing 1205. A tubular 1225 is then run into the wellbore 1200 and suspended in an overlapping position with both the casing 1205 and the clad 1210. As shown in FIG. 12A, the entire tubular 1225 is then expanded until a lower portion 1230 of the tubular 1225 contacts the inner diameter of the clad 1210. In one embodiment, an upper portion of the clad 1210, which is placed in contact with the lower portion 1230 of the tubular 1225, includes a PBR 1215 to receive the tubular 1225 and form a seal between the tubular 1225 and the clad 1205. An upper portion 1240 of the tubular 1225 is then expanded into contact with the casing 1205. The tubular 1225 now functions as a straddle to isolate the unlined area between the clad 1210 and casing 1205, as shown in FIG. 12B. The inner diameter of the expanded portion 1240 of the tubular 1225 can also be designed to function as a PBR to receive subsequent tubing or liners.

Figure 13A:
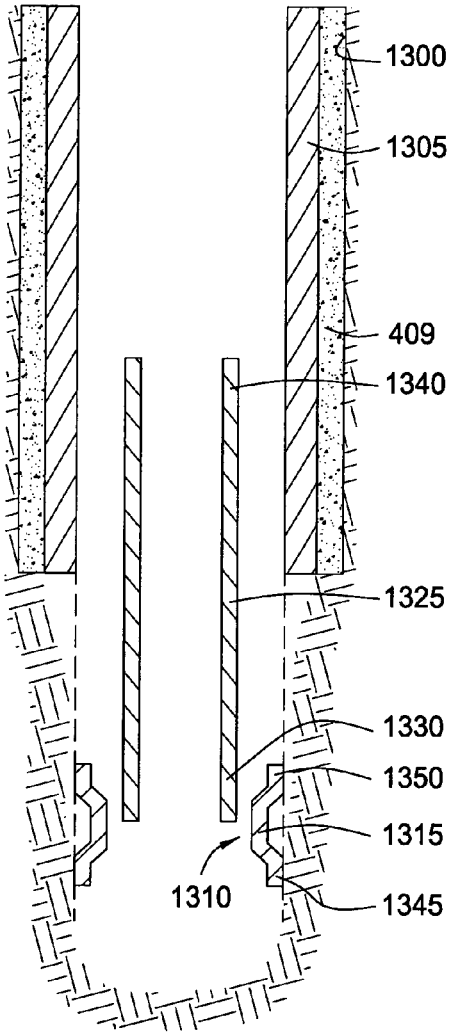
FIG. 13A–B provide section views of the present invention according to another embodiment.
Figure 13B:
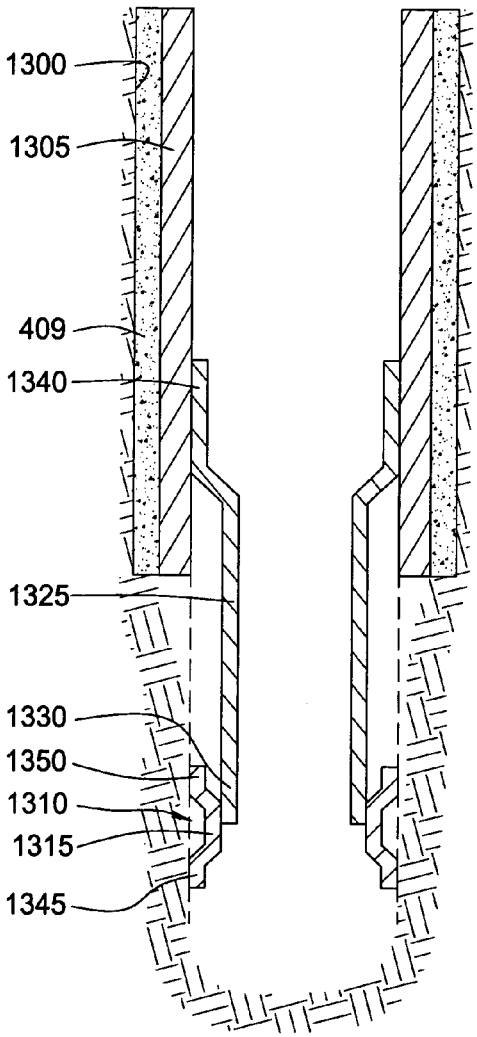

FIGS. 13A–B provide section views of the present invention according to another embodiment. As in FIGS. 7A–B, FIG. 13A illustrates a clad 1310 having been expanded at an upper portion 1350 and a lower portion 1345 thereof against an unlined section of the wellbore 1300. A tubular 1325 is then suspended in an overlapping position with both the casing 1305 and the clad 1310. Initially, the tubular 1325 is not in contact with the casing 1305 or the clad 1310. An expander tool (not shown) is used to expand a substantial portion of the tubular until a lower portion 1330 of the tubular 1325 is engaged against the non-expanded portion of the clad 1310. In one embodiment, the non-expanded portion of the clad 1310 includes a PBR portion 1315 for effectively receiving the tubular 1325 and forming a seal between the tubular 1325 and the clad 1310. An upper portion 1340 of the tubular 1325, which overlaps a bottom portion of the casing 1305, is expanded against the casing, as shown in FIG. 13B. As previously described, the tubular 1325 functions as a straddle to isolate the unlined area between the casing 1325 and the clad 1310. As in previous embodiments, the inner diameter of the expanded portion 1340 of the tubular 1325 can also be designed to function as a PBR to receive subsequent tubing or liners.

Figure 14A:
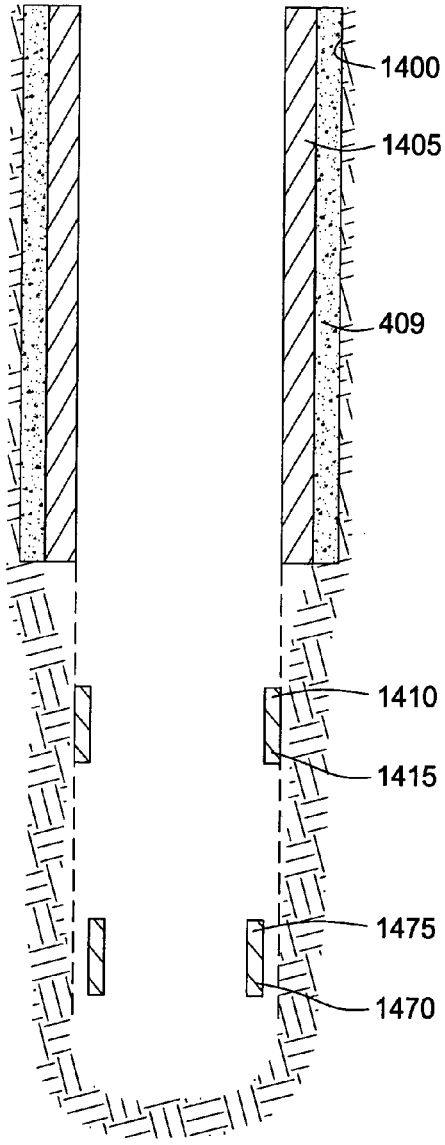
FIGS. 14A–D provide section views of another embodiment of the invention wherein more than one clad is employed within the wellbore.
Figure 14B:
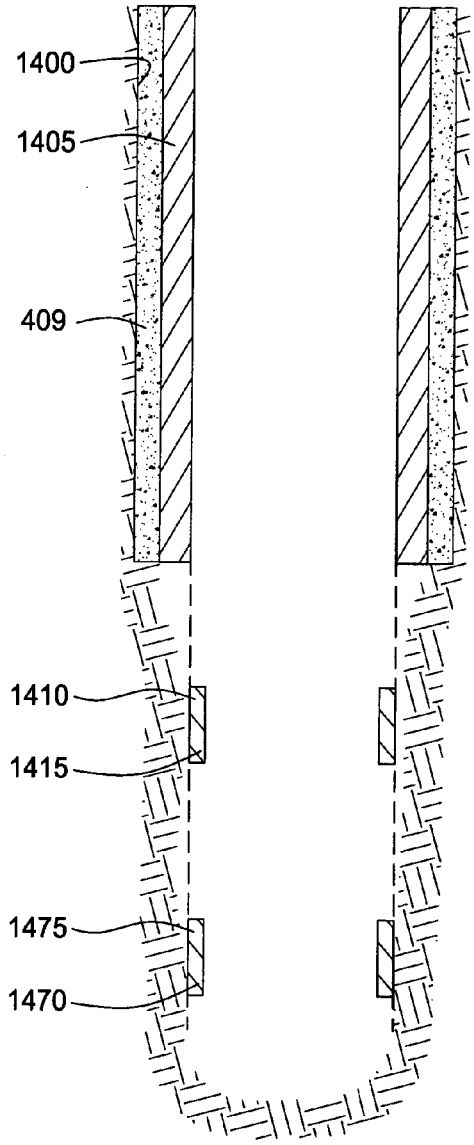

FIGS. 14A–D provide section views of another embodiment of the invention wherein more than one clad is employed within a wellbore. As shown in FIG. 14A, a first clad 1410 has been inserted within the wellbore 1400 and expanded against an unlined portion of the wellbore 1400 below an existing casing 1405. A second clad 1470 is then run into the wellbore 1400 passed the casing 1405 and suspended at a location below the first clad 1410. As with the first clad 1410, the second clad is expanded into frictional engagement with an unlined section of the wellbore 1400, as shown in FIG. 14B.

Figure 14C:
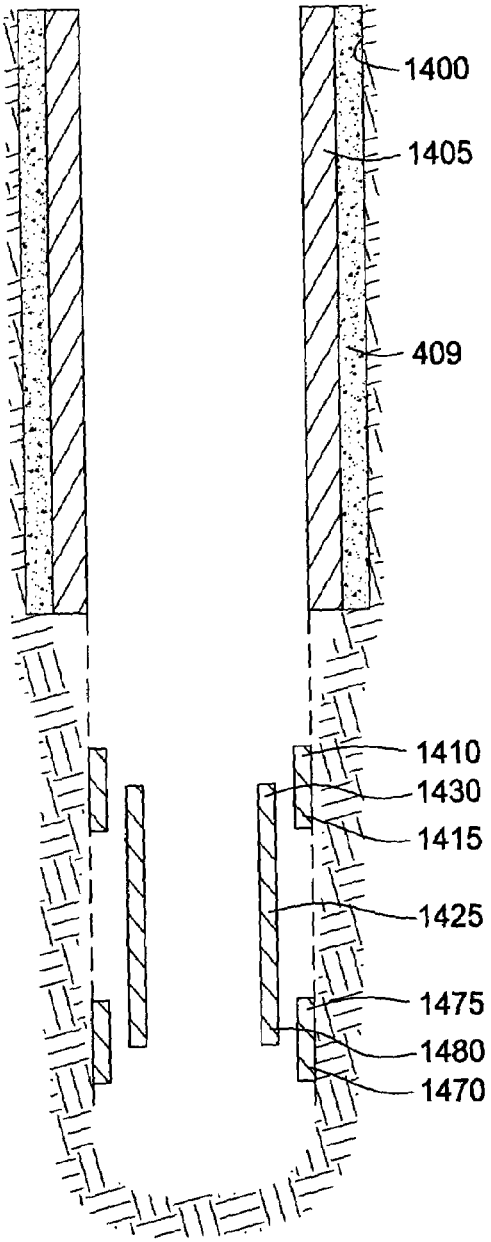
Figure 14D:
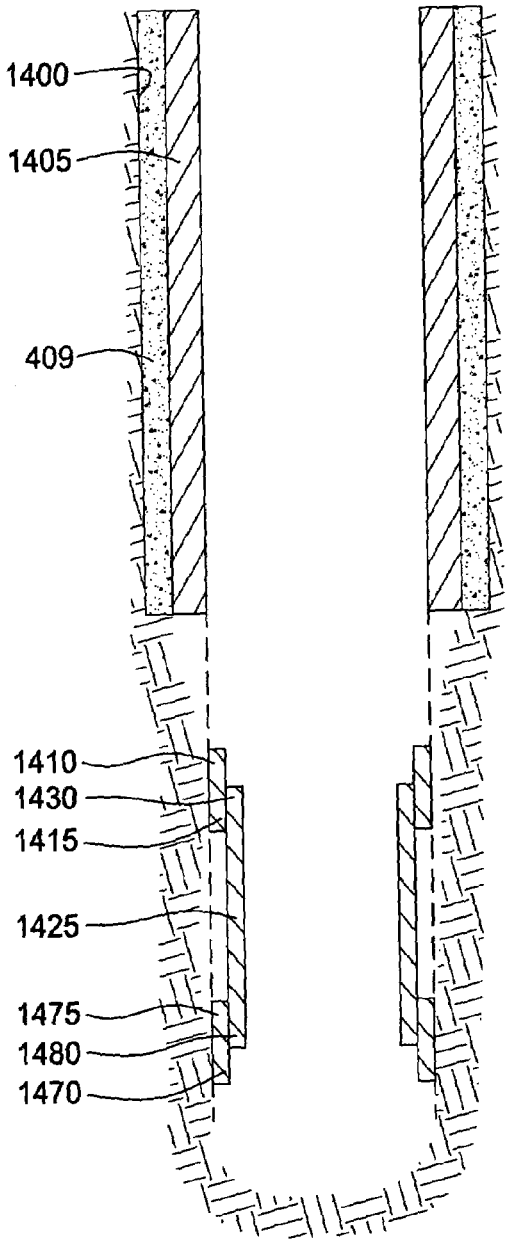

A tubular 1425 is run into the wellbore 1400 and suspended wherein an upper portion 1430 of the tubular 1425 overlaps a portion of the first clad 1410 and a lower portion 1480 of the tubular 1425 overlaps a portion of the second clad 1470. As shown in FIG. 14C, the tubular 1425 is not initially in contact with either of the clads 1410, 1470. The entire length of the tubular 1425 is then expanded until the upper portion 1430 of the first tubular 1425 contacts the first clad 1410 and the lower portion 1480 of the tubular 1425 contacts the second clad 1470. In one embodiment, the first clad 1410 includes a PBR portion 1415 disposed at a lower end thereof, and the second clad 1470 includes a PBR portion 1475 disposed at an upper end thereof. The polished bore receptacles 1415 and 1475 are designed to effectively receive and seal the upper and lower portions 1430 and 1480, respectively, of the tubular 1425. As shown in FIG. 14D, the tubular 1425 functions to isolate the area between the two clads 1410, 1470. The tubular 1425 can include a PBR disposed on a portion of the inner diameter designed to receive subsequent tubulars or liners.

Figure 15A:
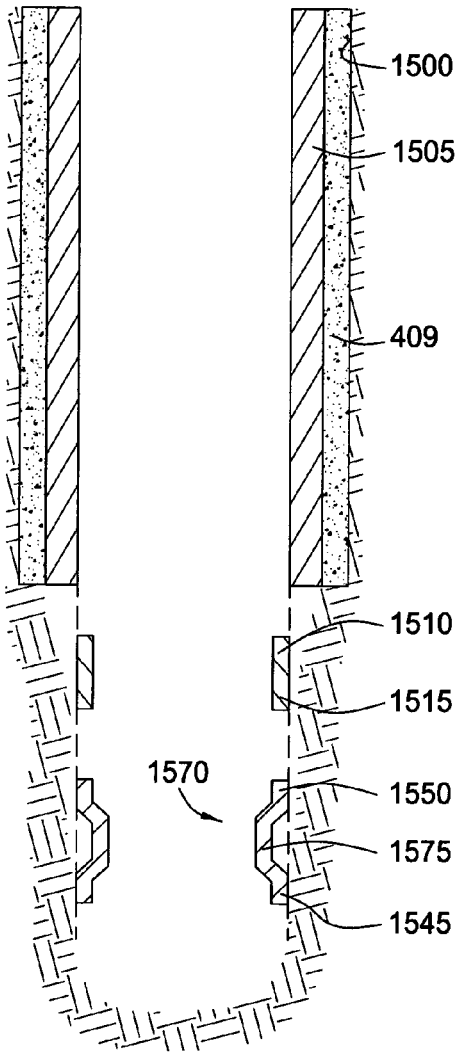
FIGS. 15A–C provide section views of the invention according to another embodiment wherein more than one clad is employed within the wellbore.
Figure 15B:
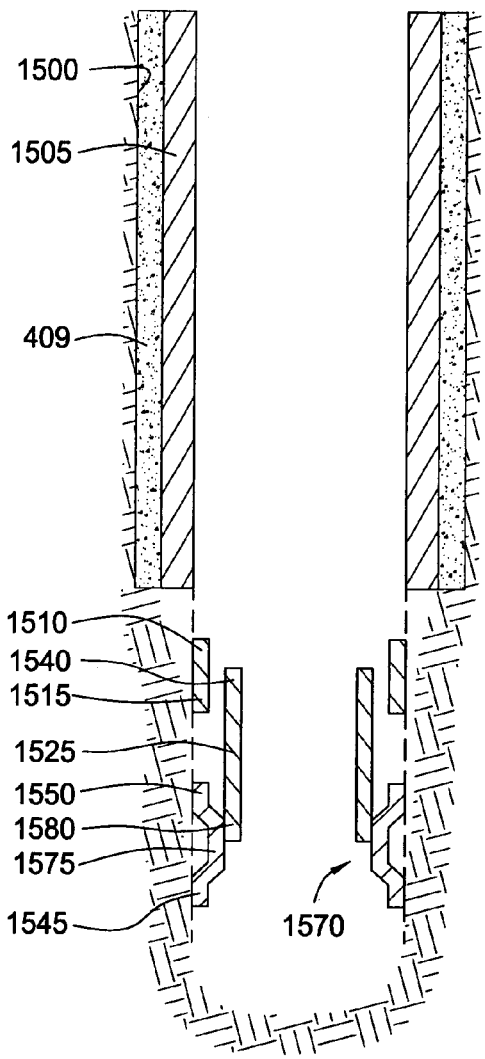
Figure 15C:
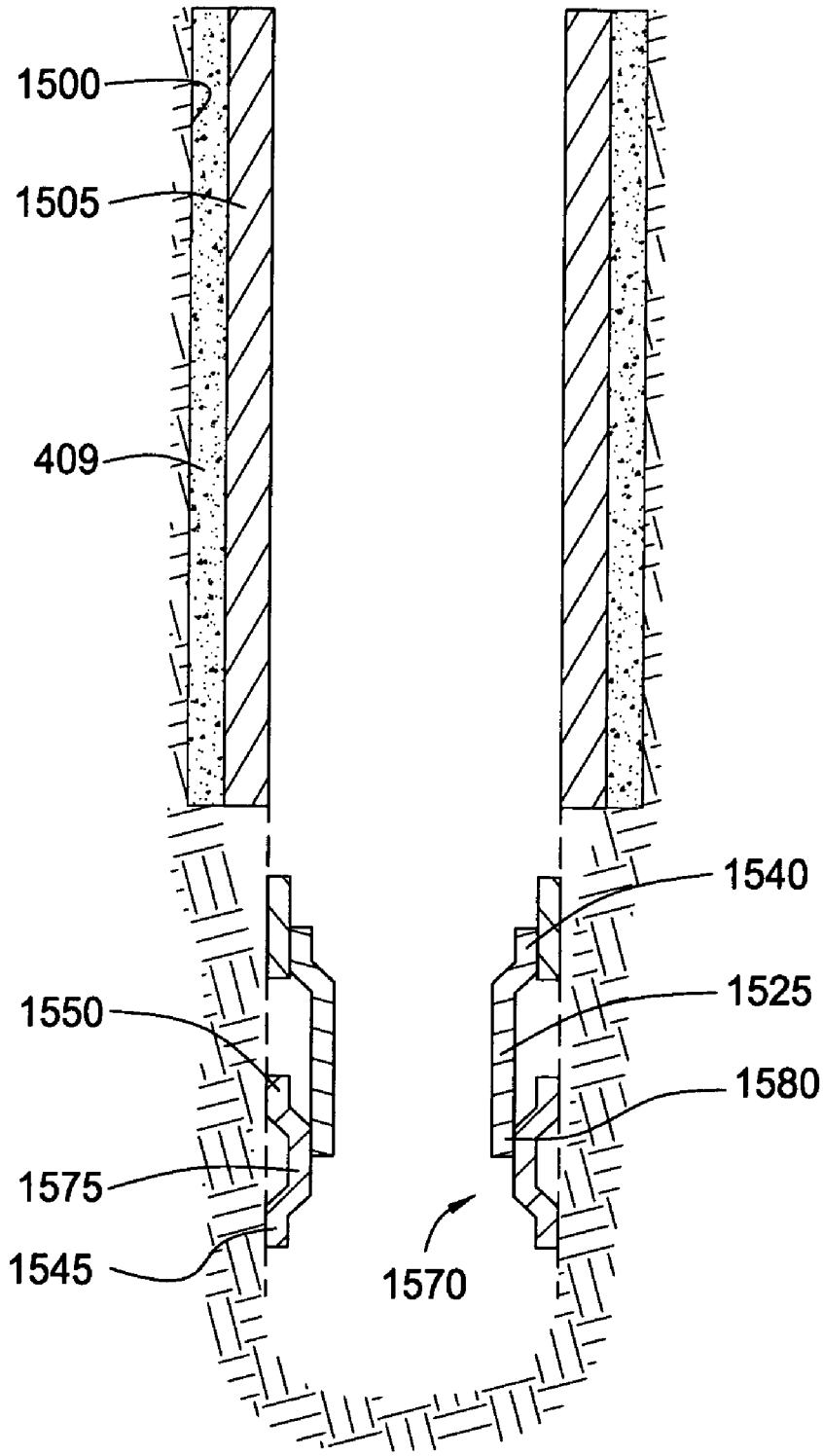

FIGS. 15A–C provide section views of the invention according to another embodiment. In a similar fashion as the embodiment described with respect to FIGS. 14A–D, the present embodiment involves the use of two or more clads. As shown in FIG. 15A, a first clad 1510 is disposed below an existing casing 1505 and is frictionally engaged to an unlined section of the wellbore 1500. A second clad 1570 is disposed below the first clad and expanded only at an upper portion 1550 and a lower portion 1545, as shown in FIG. 15A.

Referring to FIG. 15B, a tubular 1525 is run into the wellbore 1500. The second clad 1570 includes a PBR 1575 disposed between the expanded portions 1550, 1545 of the second clad 1570. As in previously described embodiments, the tubular 1525 is designed to line the PBR 1575, thereby becoming sealably engaged to the clad 1510. An expander tool (not shown) is again employed to expand an upper portion 1540 of the tubular 1525 into contact with a lower portion 1515 of the first clad 1510, as shown in FIG. 15C. A portion of the inner diameter of the tubular 1525 can also be designed to function as a PBR to receive subsequent tubing or liners. As previously described, the tubular 1525 functions to straddle or isolate the unlined area between the first clad 1510 and the second clad 1570.

Figure 16A:
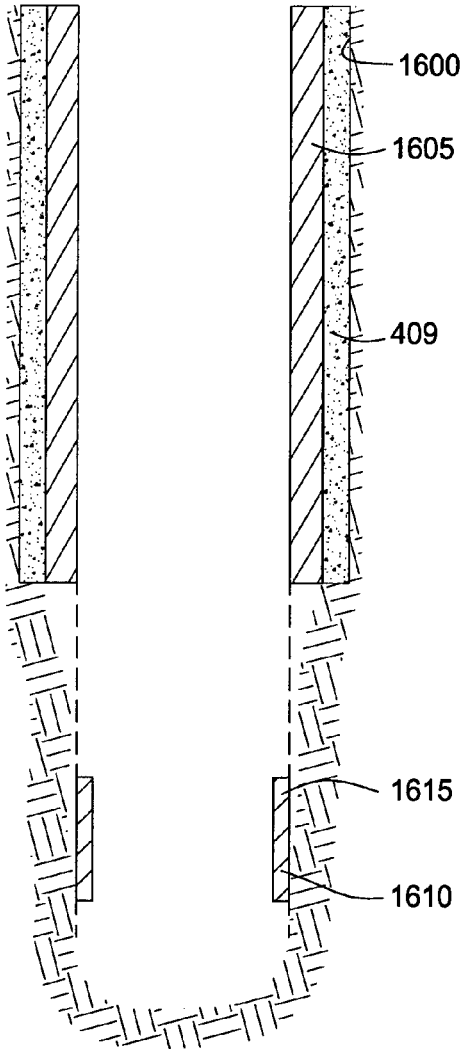
FIGS. 16A–B show section views of the invention according to another embodiment wherein a clad is employed within the wellbore.
Figure 16B:
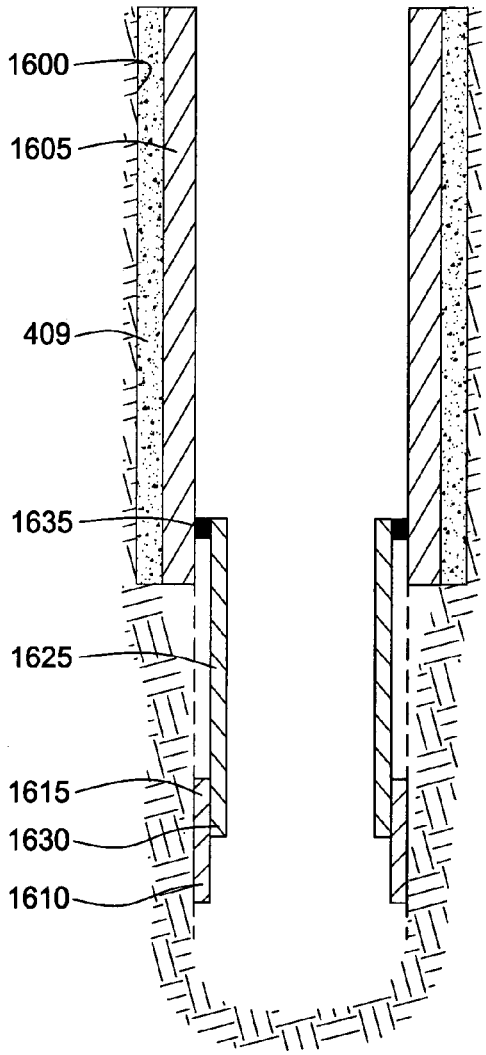

FIGS. 16A–B provide section views of the present invention according to another embodiment. As in FIGS. 6A–B, FIG. 16A illustrates a first tubular or clad 1610 located below a string of casing 1605. The clad 1610 includes a PBR portion 1615 disposed at an upper portion thereof. As previously described, an expander tool (not shown) is used to suspend and expand a substantial portion of the clad 1610 including the PBR 1615 against the present formation, thereby frictionally engaging the clad 1610 to the formation, as shown in FIG. 16A. A tubular 1625 is lowered into the wellbore 1600 within the casing 1605. As in previously described embodiments of the invention, the outer diameter of the tubular 1625 is designed to line the inner diameter of the PBR 1615. The PBR 1615 overlaps a portion of the tubular 1625, thereby forming a seal between the tubular 1625 and the clad 1610. As shown, an upper portion 1640 of the tubular 1625 is hung along a lower portion of casing 1605 by a conventional means, such as a slip mechanism 1635. However, it is understood that other hanging devices well known by a person of ordinary skill in the art can be employed to hang the tubular 1625.

Figure 17A:
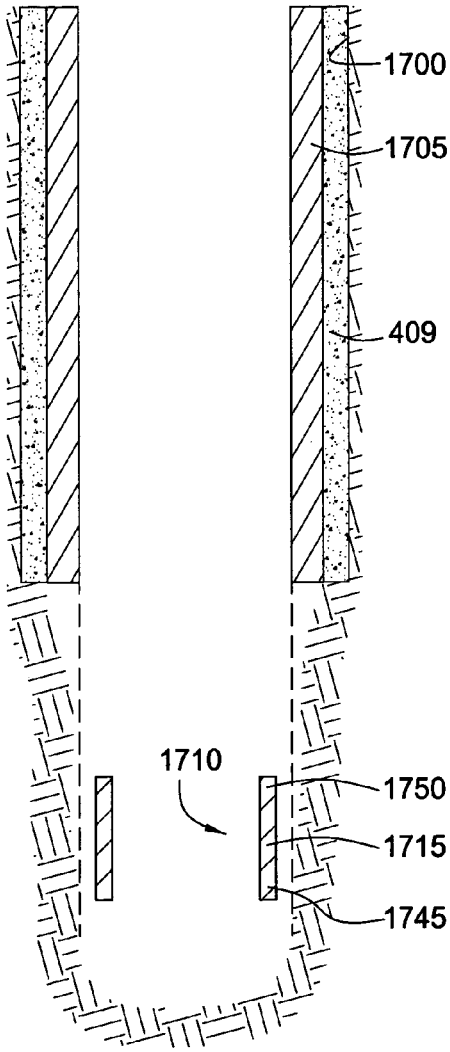
FIGS. 17A–B illustrate section views of the invention according to another embodiment wherein a clad is employed within the wellbore.
Figure 17B:
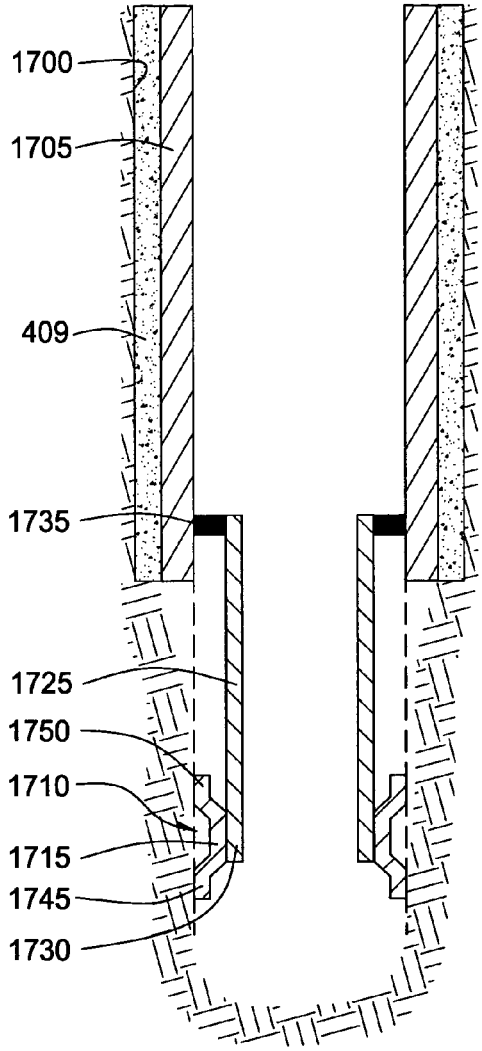

FIGS. 17A–B provide section views of the present invention according to another embodiment of the invention. As in the embodiment of the present invention described by FIGS. 7A–C, FIGS. 17A–B illustrate a first tubular or clad 1710 disposed within the wellbore 1700 below the casing 1705. An expansion tool (not shown) is used to suspend the clad 1710 within the wellbore 1700 and to then expand an upper portion 1750 and a lower portion 1745 of the clad 1710 against the surrounding wellbore 1700, as shown in FIG. 17B. A tubular 1725 is then run into the wellbore 1700 and into a PBR portion 1715 of the clad 1710. As in previously described embodiments, the tubular 1725 is designed to line the PBR 1715, thereby becoming sealably engaged to the clad 1710. As shown, an upper portion 1740 of the tubular 1725 is hung along a lower portion of casing 1705 by a conventional means, such as a slip mechanism 1735. However, it is understood that other hanging devices well known by a person of ordinary skill in the art can be employed to hang the tubular 1725.

Figure 18:
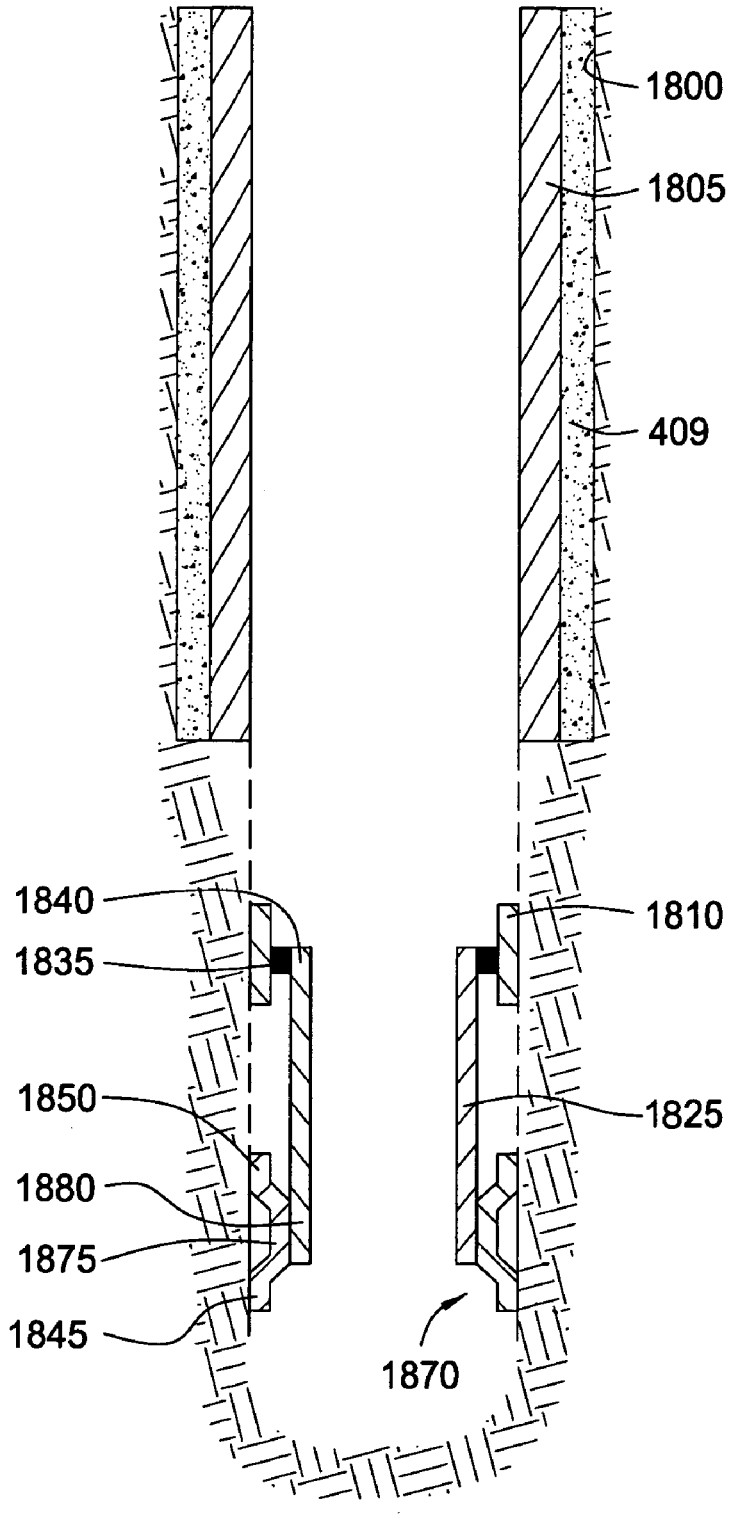
FIG. 18 provides a section view of the invention according to another embodiment wherein more than one clad is employed within the wellbore.

FIG. 18 provides a section view of the invention according to another embodiment. In a similar fashion as the embodiment described with respect to FIGS. 15A–B, the present embodiment involves the use of two or more clads. As shown in FIG. 18, a first clad 1810 is disposed below an existing casing 1805 and is frictionally engaged to an unlined section of the wellbore 1800. A second clad 1870 is disposed below the first clad and expanded only at an upper portion 1850 and a lower portion 1845. A tubular 1825 is run into the wellbore 1800. The second clad 1870 includes a PBR 1875 disposed between the expanded portions 1850, 1845. As in previously described embodiments, the tubular 1825 is designed to line the PBR 1815, thereby becoming sealably engaged to the clad 1810. An upper portion 1840 of the tubular 1825 is hung along a lower portion of casing 1805 by a conventional means, such as a slip mechanism 1835, as shown in FIG. 18. However, it is understood that other hanging devices well known by a person of ordinary skill in the art can be employed to hang the tubular 1825.

While the tubular members and clads are described as being run into the wellbore on a run in string of tubulars, it will be understood that the apparatus of the invention can be transported into the wellbore using any number of means including coiled tubing and electrical wire as well as any other means as known by a person of ordinary skill in the art.

While the foregoing is directed to embodiments of the present invention, other and further embodiments of the invention may be devised without departing from the basic scope thereof, and the scope thereof is determined by the claims that follow.

What is claimed is:

1. A method of completing a well comprising:
running a first tubular into a wellbore, wherein the wellbore comprises a cased portion;
suspending the first tubular at a selected depth within the wellbore by use of slips;
expanding at least a portion of the first tubular;
running a second tubular into the wellbore;
locating a portion of the second tubular proximate the first tubular, leaving an overlapping area therebetween; and
expanding at least a portion of the second tubular.

2. The method of claim 1, wherein a portion of the second tubular is mated into a portion of the first tubular, the inner diameter of the mated portion of the first tubular being configured to sealingly receive the outer diameter of the second tubular.

3. The method of claim 2, wherein a substantial portion of the first and second tubulars are concurrently expanded including the overlapping area between the first and second tubulars.

4. The method of claim 3, wherein an expanded portion of the second tubular is expanded until the inner diameter of the second tubular is substantially equal to the inner diameter of an unexpanded portion of the first tubular.

5. The method of claim 1, wherein the second tubular is production tubing.

6. The method of claim 1, wherein the first and second tubulars are expanded by an outward radial force applied on an inner wall thereof.

7. The method of claim 1, wherein the first and second tubulars are expanded with an expander tool having at least one outwardly actuatable, member disposed thereon.

8. A method of completing a well comprising:
running a first tubular into a wellbore, wherein the wellbore comprises a cased portion;
suspending the first tubular at a selected depth within the wellbore by use of slips;
expanding at least a portion of the first tubular;
running a second tubular into the wellbore;
locating a portion of the second tubular proximate the first tubular, leaving an overlapping area therebetween, wherein a portion of the second tubular is mated into a portion of the first tubular, the inner diameter of the mated portion of the first tubular being configured to sealingly receive the outer diameter of the second tubular, and wherein the overlapping portion of the first tubular includes a polished bore receptacle; and
expanding at least a portion of the second tubular.

9. The method of claim 8, wherein the first tubular is suspended within the cased portion of the wellbore by expanding an upper portion of the first tubular into contact with the cased portion, thereby frictionally engaging the first tubular within the cased portion of the wellbore.

10. The method of claim 8, wherein the first tubular is suspended below the cased portion of the wellbore by expanding at least a portion of the first tubular into contact with an unlined portion of the wellbore.

11. The method of claim 10, wherein the overlapping portion of the first tubular is expanded against an unlined portion of the wellbore.

12. The method of claim 11, wherein the first tubular is a clad.

13. The method of claim 10, wherein an upper portion of the second tubular overlaps and is expanded against the cased portion of the wellbore, thereby isolating an unlined portion of the wellbore between the first tubular and the cased portion of the wellbore.

14. A method of completing a well comprising:
running a first tubular into a wellbore, wherein the wellbore comprises a cased portion;
suspending the first tubular at a selected depth within the wellbore;
running a second tubular into the wellbore;
mating a portion of the second tubular into a portion of the first tubular, the inner diameter of the mated portion of the first tubular being configured to sealingly receive the outer diameter of the second tubular, thereby creating an overlapping area between the first and second tubulars; and
concurrently expanding a portion of the first and second tubulars including the overlapping area between the first and second tubulars.

15. The method of claim 14, wherein the second tubular is production tubing.

16. The method of claim 14, wherein the first tubular is suspended within the cased portion of the wellbore by expanding the upper portion of the first tubular into contact with the cased portion, thereby frictionally engaging the first tubular within the cased portion of the wellbore.

17. The method of claim 14, wherein the first tubular is suspended within the cased wellbore by the use of slips.

18. The method of claim 14, wherein the first tubular is suspended below the cased portion of the wellbore by expanding at least a portion of the first tubular into contact with an unlined portion of the wellbore.

19. The method of claim 18, wherein the overlapping portion of the first tubular is expanded against an unlined portion of the wellbore.

20. The method of claim 19, wherein the first tubular is a clad.

21. The method of claim 18, wherein an upper portion of the second tubular overlaps and is expanded against the cased portion of the wellbore, thereby isolating an unlined portion of the wellbore between the first tubular and the cased portion of the wellbore.

22. The method of claim 14, wherein an expanded portion of the second tubular is expanded until the inner diameter of the second tubular is substantially equal to the inner diameter of an unexpanded portion of the first tubular.

23. The method of claim 14, wherein the overlapping portion of the first tubular includes a polished bore receptacle.

24. A method of completing a well comprising:
running a first tubular into a wellbore, wherein the wellbore comprises a cased portion;
suspending the first tubular at a selected depth below the cased portion of the wellbore;
expanding at least a portion of the first tubular against an inner surface of the wellbore below the cased portion;

running a second tubular into the wellbore; and locating a portion of the second tubular proximate the first tubular, leaving an overlapping area therebetween.

25. The method of claim 24, wherein at least a portion of the second tubular is expanded.

26. The method of claim 25, wherein a portion of the second tubular is mated into a portion of the first tubular, the inner diameter of the mated portion of the first tubular being configured to sealingly receive the outer diameter of the second tubular.

27. The method of claim 26, wherein a substantial portion of the first and second tubulars are concurrently expanded including the overlapping area between the first and second tubulars.

28. The method of claim 26, wherein the overlapping portion of the first tubular includes a polished bore receptacle.

29. The method of claim 25, wherein an expanded portion of the second tubular is expanded until the inner diameter of the second tubular is substantially equal to the inner diameter of an unexpanded portion of the first tubular.

30. The method of claim 25, wherein an upper portion of the second tubular overlaps and is expanded against the cased portion of the wellbore, thereby isolating an unlined portion of the wellbore between the first tubular and the cased portion of the wellbore.

31. The method of claim 25, wherein a third tubular is run into the wellbore and disposed between the cased portion of the wellbore and the second tubular.

32. The method of claim 31, wherein at least a portion of the third tubular is expanded against the unlined portion of the wellbore.

33. The method of claim 32, wherein an upper portion of the second tubular overlaps and is expanded against a portion of the third tubular, thereby isolating an unlined portion of the wellbore between the first tubular and the third tubular.

34. The method of claim 33, wherein the third tubular is a clad.

35. The method of claim 33, wherein the second tubular is hung from the third tubular by the use of a slip mechanism.

36. The method of claim 24, wherein the first tubular is a clad.

37. The method of claim 24, wherein the second tubular is suspended within the cased wellbore by the use of a slip mechanism.

38. A method of completing a well comprising:

running a first tubular into a wellbore, wherein the wellbore comprises a cased portion;

suspending the first tubular at a selected depth within the wellbore;

expanding at least a first portion of the first tubular against an inner surface of the cased portion of the wellbore;

running a second tubular into the wellbore; and mating a portion of the second tubular into an expanded portion of the first tubular, the inner diameter of the expanded portion of the first tubular being configured to sealingly receive the outer diameter of the second tubular, thereby creating an overlapping area between the first and second tubulars.

39. The method of claim 38, wherein a second portion of the first tubular is expanded below the first portion until the inner diameter of the second portion of the first tubular is substantially equal to the outer diameter of an unexpanded portion of the first tubular.

* * * * *